US007871049B2

(12) United States Patent
Fontana et al.

(10) Patent No.: US 7,871,049 B2
(45) Date of Patent: Jan. 18, 2011

(54) CORNER CLIMBER

(75) Inventors: Richard Fontana, Cape Elizabeth, ME (US); David Reinfeld, Englewood, NJ (US)

(73) Assignee: DMR Holding Group, LLC, Englewood, NJ (US)

( * ) Notice: Subject to any disclaimer, the term of this patent is extended or adjusted under 35 U.S.C. 154(b) by 1562 days.

(21) Appl. No.: 11/197,385

(22) Filed: Aug. 4, 2005

(65) Prior Publication Data

US 2005/0263658 A1 Dec. 1, 2005

Related U.S. Application Data

(62) Division of application No. 10/142,738, filed on May 9, 2002.

(51) Int. Cl.
*A47F 5/00* (2006.01)

(52) U.S. Cl. ..... 248/229.1; 248/200.1

(58) Field of Classification Search ..... 248/229.1, 248/220.1, 200.1, 229.2
See application file for complete search history.

(56) References Cited

U.S. PATENT DOCUMENTS

| | | | | | |
|---|---|---|---|---|---|
| 4,208,802 | A * | 6/1980 | Berndt | 33/347 |
| 5,351,710 | A * | 10/1994 | Phillips | 137/223 |
| 5,657,972 | A * | 8/1997 | Blatt | 269/22 |
| 5,769,293 | A * | 6/1998 | Zaretsky | 224/551 |
| 5,795,001 | A * | 8/1998 | Burke | 294/64.1 |
| 5,963,992 | A * | 10/1999 | Bonner | 4/246.1 |
| 6,101,702 | A * | 8/2000 | Claycomb et al. | 29/426.4 |
| 6,210,090 | B1 * | 4/2001 | Wyse | 410/151 |
| 6,619,922 | B2 * | 9/2003 | Illingworth et al. | 416/185 |

* cited by examiner

*Primary Examiner*—Terrell Mckinnon
*Assistant Examiner*—Steven M. Marsh
(74) *Attorney, Agent, or Firm*—Ward & Olivo

(57) ABSTRACT

The present invention is a novel device for climbing inside corners, outside corners, and a variety of surfaces. The technology presented herein relies on high friction materials, suction devices, adhesive materials, pneumatic devices, etc. Specifically, embodiments of the present invention are designed to clamp onto inside or outside corners such that the devices weight, and an optional load, can be supported. Further embodiments allow the device to climb up, down, and across corners. Moreover, embodiments that can scale flat, rough, or jagged surfaces are also disclosed.

10 Claims, 13 Drawing Sheets

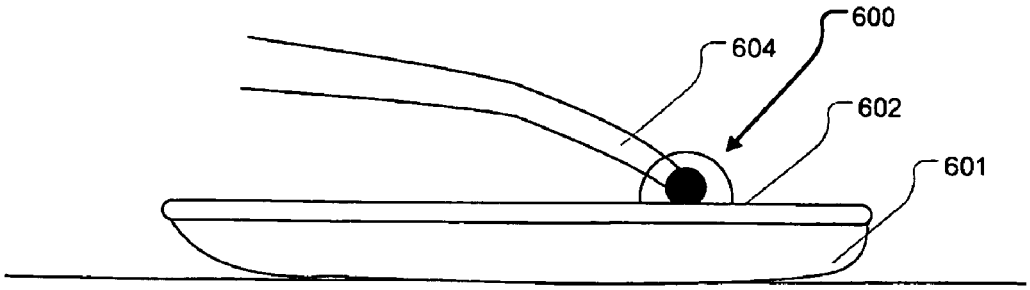
Fig. 2
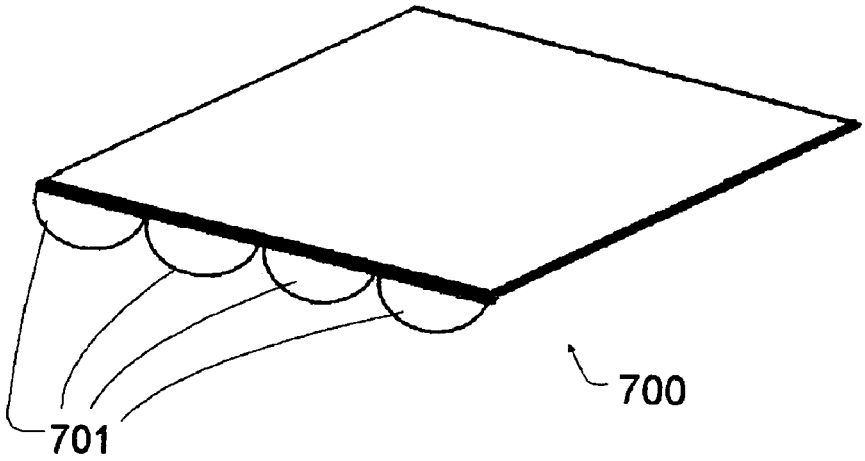
Fig. 3
FIG. 4
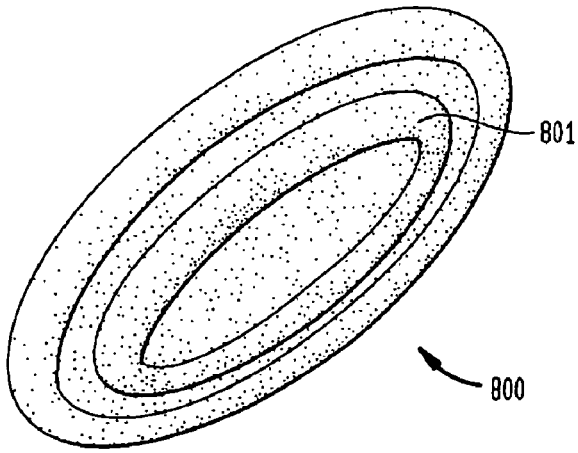

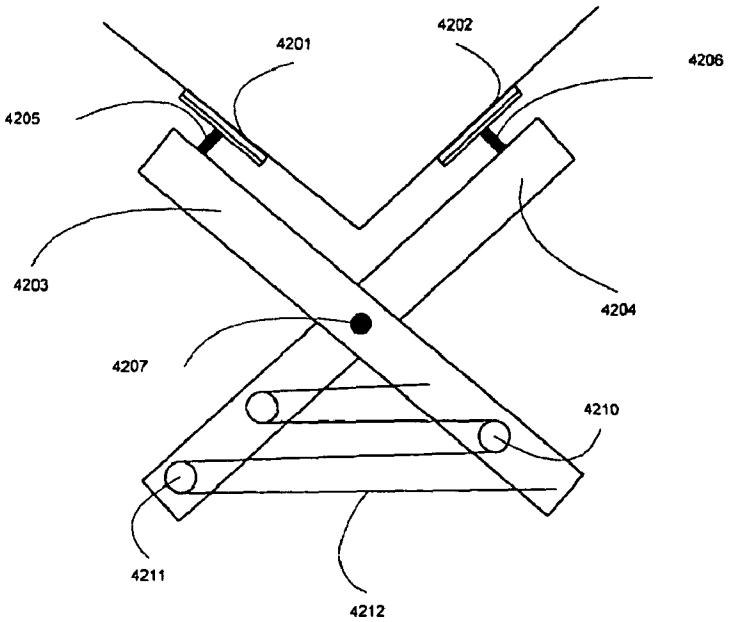
FIG. 20B
FIG. 20A
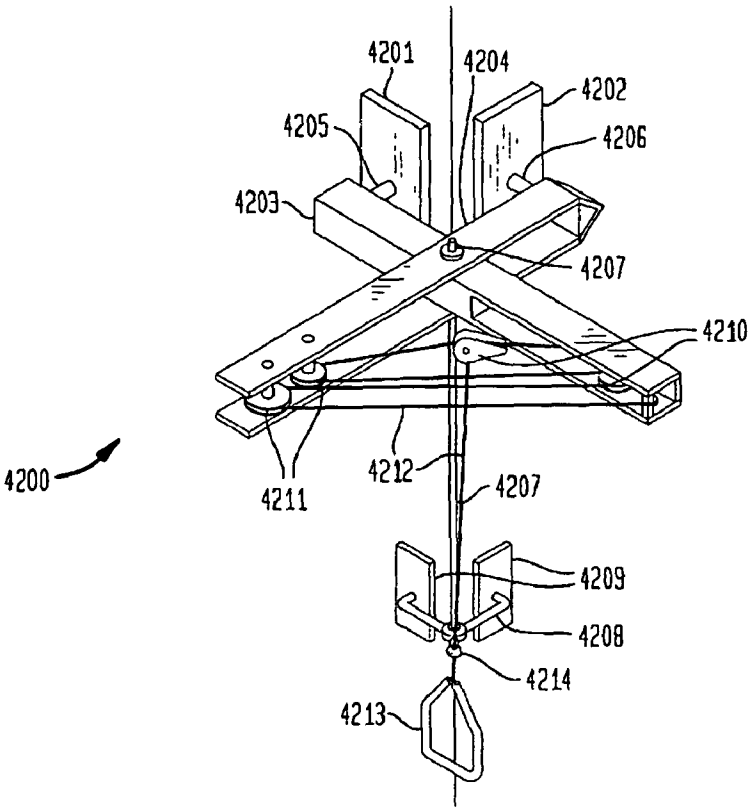

CORNER CLIMBER

This application is a divisional patent application of U.S. patent application Ser. No. 10/142,738, filed on May 9, 2002.

FIELD OF THE INVENTION

The present invention relates to a gripping and/or climbing device. The device may be either manually operated or robotically controlled. In particular, it is adaptable for climbing and/or gripping outside corners containing a wide range of adjoining wall angles.

BACKGROUND OF THE INVENTION

Using friction to clamp or climb between two parallel or substantially parallel surfaces is well known in various arts. However, the prior art is devoid of clamping or climbing devices that are capable of clamping or climbing planes that are not parallel or substantially parallel.

Climbing requires two basic capabilities: (1) the ability to achieve (and generally, but not necessarily, release) grip and (2) the ability to move. The latter of these requires the ability to lift and/or lower a person or object so that progress can be made in a desired direction. In addition, extended climbing and/or station-keeping requires some means of maintaining stability so that the person or object can maintain proper contact position and direction for extended climbing distances and periods of time.

Humans have always had the ability to climb certain surfaces without the aid of technology. For example, we can climb trees and cliffs as long as there are surfaces that afford a grip which can be used to support weight.

Technological advances have, however, greatly extended the range of climbable surfaces. For example, rock climbers can scale steep surfaces using high friction shoes while utilizing variations in the surface shape to enhance traction. With devices such as these, even extremely steep or overhanging (or inverted) surfaces can be climbed if there are pits, holes, edges, or cracks that can be gripped for traction. Other technological advances which have increased the types of surfaces we can climb or grip include mechanical jamming devices, pitons, bolts for climbing rock, belts for climbing poles, and the like.

However, these devices all have drawbacks. Mechanical jamming devices require a crack with nearly parallel walls to hold securely. Belts used for climbing poles require a way to reach around the pole, and their use is limited to objects with a relatively small diameter, such as trees or telephone poles. Pitons and bolts damage the surfaces on which they are applied and their use is often accompanied by a time consuming or noisy installation process. The various adhesive systems developed to date leave residue and/or damage the surface.

One of the most significant drawbacks of several of the previously-disclosed systems is that they require two parallel or nearly parallel surfaces. These systems do not achieve high friction coefficients and do not use geometric configurations suited to large-angle gripping. The minimum friction coefficient required to maintain an unloaded grip between walls is defined by the tangent of half of the angle between the walls. This minimum value is not adequate to support an object since it provides no capacity to hold a force other than the clamping force that acts directly between the pads. In practice, a high friction coefficient must be achieved to provide a secure grip capable of supporting objects for gripping and/or climbing purposes. In addition, the geometry of the device must accommodate the non-parallel walls.

Using the tangential relationship for the minimum friction requirement and assuming a reasonably high friction coefficient for metal on rock of 0.3 to 0.5, the maximum angle between walls is about 30 to 55 degrees respectively (not including the reduction in angle required to perform any useful function). These angles, however, are far from the 90-degree angle of typical corners. The designs used in the prior art are not suited to angles of 30 degrees or more between walls. The present invention is.

In practice, the angle required to produce sufficient grip based on the prior art is much less than 30 degrees. Thus, it is generally acknowledged that the walls of a crack must be nearly parallel to provide a secure anchor. The inability of the prior art to accommodate an angle of more than 30 degrees is due to both the choice of materials that do not achieve a high coefficient of friction and designs that cannot accommodate non-parallel geometries well. To achieve a useful grip on surfaces at angles on the order of 90 degrees, a geometry that can accommodate such angles and a friction coefficient that is greater than one (1) are required. The use of high friction materials and the ability to grip surfaces at angles substantially near 90 degrees to each other has not been previously illustrated in the prior art.

Previously-disclosed climbing systems generally fall into two categories: those which can be used to climb natural objects (such as mountains, cliffs, caves and rocks) and those which can be used to climb man-made objects (such as buildings, scaffolding, towers and poles).

Many clamping and climbing devices have been devised for climbing on rock. Many are designed to grip by applying a force between nearly parallel adjacent surfaces (cracks) in rock. Small blocks, wedges, rods, and chocks have been jammed in cracks and used to secure ropes for climbing protection and securing or hauling loads. The rod-jamming system in Bohn, U.S. Pat. No. 5,934,635 (hereinafter "the '635 patent") and specially-shaped block devices such as Prohaska, Austrian Pat. No. 395945B (hereinafter "the '945B patent") are examples. However, they are limited in use to jamming in cracks in which the walls of the crack are nearly parallel.

The '635 patent discloses a self-adjusting rock climber anchor device which includes at least one variable length compression arm. The apparatus is formed of two or more arms used to affix the device in a crevice containing parallel or nearly parallel walls. After the device has been affixed in a wedge position in a crevice, a climber may attach a rope to the apparatus for use in ascending and descending the rock face. Such a device is only useful for ascending surfaces containing crevices with nearly parallel walls, such as a mountainside. It is generally not capable of ascending smooth surfaces and/or inside and outside corners where the angle formed by the adjoining walls is approximately ninety degrees.

The '945B patent discloses a climbing wedge capable of insertion into rock cracks. The wedge is formed of convexly formed strips arranged in a direction from its end remote from the load to its end closer to the load. The device is placed into a rock crack by jamming it into the crack until the wedge is firmly secured. Frictional forces hold the apparatus securely in the rock crack. A rope or other such device may then be affixed to the climbing wedge to support an object or enable a climber to ascend and descend the rock face or other such surface. This device is useful for climbing surfaces containing small cracks in which the climbing wedge can be placed. To utilize this device for climbing, the walls of the cracks must also be parallel or substantially parallel, otherwise the device cannot sustain a gripping force capable of supporting heavy objects. The apparatus is not useful for ascending smooth surfaces and/or surfaces containing inside/outside corners angled at approximately ninety degrees.

Lowe U.S. Pat. No. 3,877,679 (hereinafter "the '679 patent") describes a device based on a cam that is used in similar cracks. Lowe discloses a chock stone device containing a cam used to wedge the main body of the device between opposed pairs of tapered walls (i.e., walls which are parallel or substantially parallel). The device is used by inserting the main body into a crevice and actuating the cam device, thereby causing the upper part of the main body to expand, thereby securing the device between the tapered walls. Objects can then be supported by the device by attaching them to the main body of the apparatus. For example, a climber may attach a rope to the device and use it to ascend a cliff face. This device is only useful for climbing surfaces containing crevices with parallel or nearly parallel surfaces. The apparatus also mars the climbing surface, since the upper portion of the main body contains saw-like teeth used to help secure the device in position. This apparatus is not capable of helping a climber ascend smooth surfaces and/or surfaces in which the tapered walls are not substantially parallel.

There have been many related inventions to the '679 patent, such as: Lowe U.S. Pat. No. 4,645,149 (hereinafter "the '149 patent"), Brodie U.S. Pat. No. 4,712,754 (hereinafter "the '754 patent"), Christianson U.S. Pat. No. 4,643,377 (hereinafter "the '377 patent") and Taylor U.S. Pat. No. 4,575,032 (hereinafter "the '032 patent"). These cam devices were developed to provide a wider range of crack size accommodation, easier placement and removal, and more security in parallel cracks than previous wedging systems.

The '149 patent describes a camming device that is useful in climbing surfaces containing natural or man-made openings therein and into which a camming device may be inserted to facilitate climbing. The camming device is comprised of cam members containing a serrated arcuate (arm positioned adjacent to a support arm. To utilize the device, the serrated portion is first inserted into the crevice. Next, the support arm is moved to a position perpendicular to the arcuate arm. This causes the serrated portion of the camming device to expand and lock the device into the crevice. The cam device is removed by moving the support arm back to its original position and sliding the device out of the crevice. Since the camming device utilizes a serrated edge, it is only useful in applications in which the surface may be marred. In addition, such a device is not adaptable for climbing smooth surfaces and/or surfaces containing inside and outside corners positioned at approximately ninety degrees.

The '754 patent describes an anchoring device for releasably anchoring within a crack within a rock face, the crack having parallel or substantially parallel walls. The device contains a cam member, a load cable, and an expansion and retraction structure. The cam member has a convexly curved surface. The device is utilized by inserting the cam member into the crack within the rock face and actuating the expansion structure which causes the cam portion of the device to grip the opposing walls of the crack. An object may then be attached to the anchoring device via the load cable. To remove the device from the rock crack, the retraction structure is used to release the cam device so it can be removed from the crack. The geometry of this device allows it to be used to anchor in surfaces containing cracks having parallel or substantially parallel walls. The device is not useful for climbing surfaces having inside/outside corners.

The '377 patent discloses an improved climbing aid formed of one or more pair of opposing cam members, two or more parallel axles on which the cam members may pivot, and a looped cable member connected to the main body of the device to which a load may be attached. To expand and retract the cam members, the device also incorporates spring members which act to simultaneously move the cam members toward an expanded position and an operating member connected to each cam member used to retract the cams. The device is used by inserting the cam member portion of the device into a crack containing parallel or substantially parallel walls and actuating the spring members, thereby causing the opposed cams to expand and affix the device in the crack. A load may then be supported by the device by attaching it to the looped cable member. The device can later be removed from the crack by using the operating member to retract the cams. This device is limited to use on surfaces containing cracks and is not applicable to surfaces containing inside corners and outside corners in which the adjoining walls are not parallel or substantially parallel.

The '032 patent describes an apparatus composed of three (3) opposed cams containing teeth on their outer surface. The cams are attached to a shaft and spring loaded to rotate to their widest point of separation. A pull rod is slideably located within a slot in the handle portion of the device. When the pull rod is manually retracted, it forces the cams to also retract. The device can then be placed inside a crack. When the pull rod is released, the cams return to the open position and grip the internal surface of the crack in a chock-like manner. Similar to the previously described prior art, this device aides in climbing surfaces with natural or man-made cracks, but it cannot be utilized to climb surfaces which are not and must not be marred or surfaces containing inside/outside corners arranged at an angle of approximately ninety degrees.

There are also several systems based on multiple sliding wedges and/or rollers such as Byrne EPO Pat. No. 0323391 (hereinafter "the '391 patent), Frechin French Pat. No. 2553668 (hereinafter "the '668 patent), and Guthrie et al. U.S. Pat. No. 4,643,378 (hereinafter "the '378 patent").

The '391 patent depicts a self adjusting climbing chock formed of a looped end and first and second cable end sections. A fixed wedge element and a translating wedge element are attached to the cable end sections. The translating wedge element is normally held in a retracted position by a spring. To utilize the apparatus to climb, the chock portion of the device is inserted into a crack and weight is placed on the looped end, causing a spring to expand and the translating wedge element to move away from the fixed wedge element, thereby causing the wedge elements to press against the walls of the crack and support the weight placed on the looped end of the apparatus. The device may be disengaged from the crack by removing the force placed on the looped end of the device. The translating wedge element will then return to its contracted position, allowing the device to be removed from the crack. This device is capable of aiding a climber only on surfaces containing cracks with parallel or substantially parallel walls. This patent does not disclose any method or apparatus of climbing surfaces formed from either inside or outside corners in which the walls meet at approximately a ninety-degree angle.

The '668 patent depicts a nut composed of two adjacent half-wedges. The wedges are joined together by a cable. The wedges can be rotated relative to each other to achieve different wedge geometries. A ring clasp on the rope connecting the two half-wedge can then be used to immobilize the wedges from moving relative to one another. The device can then be inserted into cracks of various sizes by forcing the configured wedge into a crack so that it does not easily slide out. The rope attached to the nut can then be used to aid in climbing a rock wall or other such surface with cracks. However, this device is not capable of aiding a climber in ascending inside or outside corners arranged at an approximate angle of ninety degrees because the wedges, as disclosed, are not designed for use in such a geometry.

The '378 patent discloses a roller-chock climbing aid composed of a wedge shaped chock, a roller, a spring, and a release cable. The wedge shaped chock and roller are arranged next to each other and connected by said spring. When the release cable is pulled downward by a climber's weight, the roller chock moves away from the wedge shaped chock and affixes the apparatus in a crack in a similar manner to the device disclosed by Byrne. To remove the device from a crack, the applied force must be taken off the release cable. The spring connecting the roller to the wedge shaped chock returns the device to its original position, allowing it to easily be removed from the crack. As disclosed, this apparatus is not capable of ascending adjacent corners formed from walls adjoined at approximately a ninety-degree angle.

These multiple wedge devices were developed to achieve the advantages of the cam systems in ease of use and security in application to very small cracks that are too small for a cam design to work. All of these devices have proven useful when properly used in suitable cracks with parallel or nearly parallel faces. They are used to secure safety ropes of people climbing as well as supporting people, temporary shelters, equipment and the like during expeditions. Crack jamming devices have been developed to span a very wide range of crack sizes, yet all of these devices are limited in use to cracks in nearly parallel walls. These devices are useless when the surfaces containing the cracks are not substantially parallel.

In addition to the previously-noted devices for holding in cracks, hooks and other hook-like devices have been used to grip external features projecting from walls. These hooks, however, are severely limited in their application to surfaces that are nearly perpendicular to the direction of the applied force, such as ledges.

Although high friction shoes are commonly used in rock climbing, none of these devices can grip surfaces that are not nearly parallel in nature and none are designed to hold on outside or inside corners that approach right angles.

Drilling and bolting to a rock surface is a means of providing secure attachment to a single surface. Most applications of drilling and bolting are used in rock climbing to leave fixed brackets for mounting protective equipment while climbing. One disadvantage of this approach is that a large supply of components is required since the bolts are left in the wall.

For example, Checkett, PCT App. No. PCT/GB97/00620 (hereinafter the '620 application") describes a removable and replaceable bolt, which allows the bolt to be removed, but this still requires drilling a hole before placement of the bolt and leaves a hole after removal. Although bolting allows a grip to be achieved on most thick, strong and drillable surfaces, and can thus be used on most rock and many building surfaces, there are many serious drawbacks to the technique. Drilling rock is time consuming, noisy, and requires a lot of power. The hole mars and weakens the rock or building surface. The pressure generated by bolting is also very high, so that the surface must be of a relatively high strength material to hold the bolt when loaded. Thus, drilling and bolting is not a suitable means of clamping when minimizing weight, time, noise, surface damage, and/or power is of value or when speed, stealth, reusability, and/or the ability to leave no trace is required.

Clamping and climbing devices have also been developed for man-made structures. Many skyscrapers and large structures have tracks or other features built into them to aid with building and window washing. Special climbing devices made to fit specific features of specific buildings have also been developed. None of these approaches are suited to general use because they rely on specific features of each building that are not common on most structures or natural surfaces.

Scaffolding is commonly used to overcome the limitations on available building surface climbing and holding technology. Many climbing and clamping systems have been developed for scaffolding, so instead of attempting to climb the building directly, the scaffolding is climbed. Scaffold climbing devices, typified by inventions such as Swager U.S. Pat. No. 3,933,220 (hereinafter "the '220 patent"), Lewis U.S. Pat. No. 4,368,801 (hereinafter "the '801 patent), and Fullam et al. U.S. Pat. No. 5,806,628 (hereinafter "the 628 patent") are very specific to the features of the scaffolding. All rely on the basic concept of reaching around or inside a consistent feature of the scaffold structure to provide a secure clamp.

The '220 patent discloses a safety clamping device for use by climbers mounted in an elongated slot in a support rail. The clamping device and the support rail contain wedges configured such that the two sets of wedges interlock. The safety clamping device contains a trigger arm which allows the wedges of the clamping device to be disengaged from the wedges of the support rail. The climber can then slide the clamping device to a new position to aid in ascending or descending the structure to which the support rail is attached. This device is only applicable to geometries containing some type of support rail containing wedges and is not useful for ascending or descending natural phenomenon containing an unstructured geometry. This device is additionally not suited for climbing inside or outside corners, even if the adjoining walls are substantially parallel.

The '801 patent depicts a column climbing device for climbing columns such as girders having flanges. The device is designed to be worn on the feet of a climber and is equipped with a gripping member having spaced apart jaws adapted to grip a column flange. The gripping member on each foot is mounted for selective swinging between two positions. In one position, the jaws of the gripping member extend in the direction of the climber's toes. In the retracted position, the jaws extend laterally outwardly and behind the heel of the climber's foot so as to be out of the way when not used in climbing. This apparatus is useful for ascending highly organized, man-made surfaces. It is not designed for use in climbing any other surface geometry.

The '628 patent describes a climbing device for attaching to building frames having a pair of jaw members movable with respect to the other. The spacing between the jaw members may be adjusted using a lever device to permit a user to detachably affix the device to the frame of the building. The climbing device additionally contains a foothold and a harness to support a user. Similar to the apparatus disclosed by Lewis, this apparatus is useful for ascending highly organized, man-made surfaces. It is not useful for climbing surface geometries onto which the jaw members cannot grip.

All of these prior art devices are designed so that a component of the normal force (the force perpendicular to the contacting surfaces) provides a net force that at least partially assists with retaining the device. Although there are some towers with scaffold-like construction, clearly most natural and building structures do not have features that can be grasped in the manner used by scaffold gripping systems; if they were, there would be no need for the scaffold.

There are also many clamping/climbing devices for climbing poles and trees. Johnson U.S. Pat. No. 6,264,000 B1 (hereinafter "the '000 patent") and Brust WO Pat. No. 59,682

(hereinafter "the '682 patent") describe clamp systems based on encircling a tree or pole with a belt or rope.

The '000 patent discloses a tree stand and climbing apparatus. The device utilizes a plurality of belts which may be flexible in nature and/or contain teeth. The belts are looped around the tree in a U-shaped manner and attached to a person's body or stand. A person may utilize such a device to climb a tree/pole by alternately moving the belt and the climber's feet up the tree, which results in the overall upward motion of the climber. The climber may also descend the tree/pole in a similar fashion. This invention is useful for attaching a stand to a tree or pole or climbing such an object. However, the object cannot be used to ascend any surface which the belt cannot encompass, such as the corner of a building or a rock face.

The '682 patent discloses a fall prevention device which may also be used for climbing pole shaped objects. The device utilizes a rope or other such object which is wrapped around the pole. On the side of the pole where the ends of the rope meet, the ends are fed through a connecting element. The ends of the rope are then looped back around the post structure along their original path. Each end of the rope is affixed with an attachment structure, such as a loop or clip. A climber utilizes this device for safety by attaching the ends of the rope to some structure located on the climber's body. The force that a climber's weight exerts on the rope during a fall causes the rope to tighten around the pole, thereby preventing the fall. The device may also be used for climbing a pole type structure by relieving the tension from the belt, moving the belt up the pole, and then re-tensioning the belt. In this manner, a climber may either ascend or descend a pole type structure. However, as is the case with other belt devices, this invention is only useful as a fall prevention device on pole type structures and is not readily applicable to other geometries.

Andruchiw U.S. Pat. No. 4,527,660 (hereinafter "the '660 patent") and Swett U.S. Pat. No. 4,410,066 (hereinafter "the '066 patent") describe climbing systems based on similar techniques of reaching around a tree or pole combined with a stepwise climbing motion. In addition to reaching around the tree or pole with a belt, it is apparent that a relatively stiff structure such as a hook or closed U reaching part way around a tree or pole can work in a similar manner to a belt or rope.

The '660 patent discloses a pole climbing aid comprising a belt member attached to the waist of the climber as well as a hand grip member which is meant to aid in climbing and serve as an extra precautionary measure. The belt attached to the climber's body is used to climb the pole as is well known in the art. The hand grip member is an additional component of the device which is connected to the belt member via a connection means, such as a rope. The device may include any number of hand grips. As the climber ascends the pole, the hand grip device is disengaged from the pole and repositioned at a higher position on the pole. In this manner, a climber may descend a pole with this apparatus. This device may be used to climb any pole type structure which a belt may encompass and which a hand grip may be attached to. However, such a device may not be useful for ascending large diameter poles because the handgrip could not easily be attached to the pole's surface. The device is not adaptable for climbing most other geometries, such as the corners or surfaces of buildings.

The '066 patent discloses a tree stand apparatus which utilizes a U-shaped frame surrounding the tree to suspend the tree stand at the desired elevation. The device provides a covered frame, with openings in the top and bottom and means to securely close the openings. The tree stand may be fashioned from wood or any other similar lightweight and durable material. The entire frame may be elevated by a single operator. Such a device is only useful in geometries in which a U-shaped frame can encompass the entire object. No other means is disclosed to suspend the tree frame at the desired elevation.

A major disadvantage of such devices is that since they encircle all or most of the tree, they do not easily allow limbs to be passed. Like the scaffold climbing apparatus, none of the tree and pole climbing devices can be utilized for general climbing of common building features.

Ingro U.S. Pat. No. 3,810,515 (hereinafter "the '515 patent") describes a magnetic crawling device that utilizes magnetic forces to achieve traction to climb and maneuver on walls. Clearly, the requirement of magnetic walls is a severe limitation for many applications, since most walls are not surfaced in and/or made of magnetic material. Such magnetic climbers, in addition to severe limitations on what materials can be climbed, have numerous other problems such as attraction of debris due to the magnetic field and the relatively low forces that can be generated. Although they have application to specific situations, magnetic systems are severely limited and not suited to general use on the majority of surfaces. Ingo also describes use of suction power to achieve attractive force so that a ferrous wall is not required.

You U.S. Pat. No. 4,477,998 (hereinafter "the '998 patent") describes a system of suction cups on a belt for climbing on walls. The '998 patent describes a wall-climbing toy consisting of a belt drive mechanism with suction cups attached along the surface of the belt. To climb a wall, the toy is first affixed to the wall using the exposed suction cups attached to the belt drive mechanism. As the belt rotates, new suction cups are introduced to the wall surface as old suction cups are forcibly removed from the wall surface. In this manner, the toy may ascend or descend the wall. Such a device will only work on very smooth surfaces to which a suction cup will adhere. Additionally, the device must also be lightweight because the only force affixing the toy to the wall is provided by the suction cups. The device lacks the ability to ascend rough surfaces and the ability to navigate corners.

German Pat. No. 19727421A1 (hereinafter "the '421 patent") to Schmierer describes a similar tracked suction-cup climbing robot. The '421 patent discloses a wall-climbing apparatus also consisting of a belt drive mechanism with suction cups attached to the surface. The Schmierer device improves on the You device by pairing the suction cups on the belt. By doing so, this device can navigate bumpier surfaces because of the increased number of pads. It also has the capability to carry a larger weight load. However, the device also has the same limitations as other suction cup device. For example, the surface must be relatively smooth or the suction cups will not adhere. This device also cannot navigate corners or other such obstacles.

Winkler WO Pat. No. 37,728 (hereinafter "the '728 patent") describes a vacuum action climbing system based on suction modules that can be mounted to a user's hands and feet and driven by a vacuum-generating device to allow a person to climb the walls of buildings. The '728 patent discloses a backpack mounted vacuum system and fan shaped suction pads on hands and feet that would allow climbing of relatively smooth and walls and ceilings. All of theses devices require a wall with the proper characteristics for achieving traction. Due to the fact that atmospheric pressure is generally less than 14 psi, there are inherent limitations on the lifting capacity for a given size for any suction based device because adequate area is required to achieve a required force. If a wall is too rough or porous, the suction cups will not work. If the vacuum-generating device disclosed in the '728 patent is capable of achieving adequate suction on a rough surface, then it must continually pump air, requiring an impractical amount of power for climbing many building and natural surfaces. A device capable of producing suction force on rough surfaces efficiently would clearly be useful for clinging to surfaces, but still would not enable extremely long duration gripping, very high forces, or completely silent operation compared with mechanical based gripping systems. Incorporated by reference is co-pending application Ser. No. 09/316,318 which discloses a vortex attractor capable of use in the present invention.

Crabbe British Pat. No. 2,131,475 (hereinafter "the '475 patent") describes roof top gripping and climbing appliances that utilize high friction material to achieve grip on slanted surfaces such as roofs. The '475 patent describes achieving a coefficient of friction greater than one in experiments. Crabbe achieved an effective coefficient of friction of 1.5 for gritty concrete using high friction surfaces made of foam materials. Required thicknesses suitable for several types of roofing are described. Gripping on roofs of steeper than 45-degree pitch was achieved only for a few specific surfaces and conditions. The invention of the '475 patent, although useful for roofs, has no use in scaling vertical surfaces and thus has no use in most climbing applications.

As stated above, each piece of prior art has its own particular disadvantages, but one of the most basic shortcomings of the prior art as a whole is that nothing disclosed therein is capable of climbing and/or gripping one of the most common surface features—inside and outside corners. Such corners are typically of relatively large opening angle. Often, surfaces meet at approximately 90 degrees in corners. The Applicant is unaware of any prior art which discloses a gripping and/or climbing device that is capable of clinging to and climbing a corner where the walls meet at approximately 90 degrees. The present invention accomplishes this.

Clearly what is needed in the art is a device for gripping and climbing corners utilizing the available adjacent surfaces. An invention that makes use of nearly universally available surface features, requires little power, makes little noise, does not damage the surface, and can be scaled up or down to accommodate a wide range of applications including small robots, humans, or large systems is an advancement of the art and is disclosed herein as the present invention.

SUMMARY OF THE INVENTION

The present invention is directed at an apparatus for clamping to and climbing surfaces. It utilizes high friction material acting on adjacent surfaces, such as corners between adjacent walls, to achieve grip. The invention is capable of achieving grip between surfaces at angles from approximately parallel or enclosed relative to the angle of force, as are many of the above inventions. However, unlike previous art, the present invention is able to grip surfaces that are not parallel or nearly parallel. The present invention is capable of gripping and climbing outside corners where the walls meet at approximately right angles. It utilizes high friction materials or adhesives to develop grip. Depending on the achievable coefficient of friction, this invention is capable of gripping and scaling corners of walls and/or ceilings that meet at approximately right angles or even more adverse angles.

Objects that can be climbed with the present invention are not limited to corners. They include many types of surfaces and intersections of surfaces and curved surfaces. For example, a quarter pillar in a corner can be gripped and/or climbed using the present invention. Many natural objects also have climbable features. Many cliffs and trees have features that can be gripped with the present invention.

The present invention may be used alone or in conjunction with other mechanical or electrical systems. It has the functional ability to clamp, climb, lift, hold, suspend, jump or bounce. The general uses and additional examples described herein are accomplished by providing a gripping and/or climbing device capable of supporting loads in an inside or an outside corner geometry. Embodiments of the present invention generally include pads used for gripping inside and outside corners, wherein the pads are adjoined via a connection means. The pads may be of any shape to suit the particular geometry being climbed and/or gripped. For example the pads may be circular, round, inflatable, flexible, stiff, etc. The pads may additionally be suction cups or any other such device capable of gripping a surface. The connecting means may also be of any shape or size. For example, the connecting means may be formed of a telescopic pole containing a spring. Generally, the connecting means provides the grip force. It may even be part of the pads.

Materials of construction may vary depending upon the desired application. Materials may either be high friction, depending upon the desired application of the device. The body of the device may be composed of any suitable material. For climbing purposes, the material would more likely be lightweight; however, this is not a required condition. The pad material may be made of any high or low friction material; although there are some applications in which low friction pads might have applications, most applications described require high friction materials. The material may be flexible, so as to be compressible, compliant, inflatable or bendable, or it may be solid.

The material may be flexible, so as to be inflatable or bendable, or it may be solid.

In short, the present invention provides a general-purpose climbing and clamping tool that is (or can be designed to be) noiseless in operation, non-marking, non-damaging, fast, relatively insensitive to weather conditions, and is lightweight. The device may be employed for numerous purposes and has many military, commercial, industrial, household, recreational and entertainment-related uses.

Military—The present invention has many military applications. For example, it can be used to aid with mobility. Mobility applications include the ability to move personnel over natural terrain (such as cliffs and mountains) as well as man-made structures such as walls and buildings. On natural terrain such as cliffs, the invention allows rapid, silent, non-marking, and secure gripping and releasing of surface features for which no other capable technology currently exists. The present invention has advantages even where current devices which can grip parallel or nearly-parallel could also be used. Aside from the obvious advantage of not having to carry additional devices other than the invention for these parallel sided cracks, the invention provides a non-marking, low noise grip capability. When the crack does not have nearly-parallel sides, the existing technology of pitons or drilling and bolting are slow, noisy, and leave lasting evidence of use. By making use of common features otherwise of little use, the invention replaces many technologies and provides many advantages over existing technologies where either one can be used.

Thus, the present invention increases the range of terrain that can be accessed whether it is for maintaining position or climbing up, down, or across. It also reduces the amount of equipment that must be carried and allows rapid, covert deployment in terrain otherwise inaccessible.

On man-made environments, the present invention has all the advantages over existing technology as previously described for natural objects. An additional advantage is that most man-made obstacles such as fences, walls, and buildings are not suited to any other means of climbing. However, they are extremely well-suited to climbing using corner features which are inherent to most man made obstacles. The rapid, non-marring, and silent operation of the invention also provides substantial advantages in avoiding detection. Since the same equipment can be used for both natural and man-made terrain, there are additional advantages in logistics and ease of use. These advantages in mobility can be applied to both personnel and machines.

The present invention can also be used for surveillance. Surveillance applications include the ability to get in and out of a surveillance position using people and/or machines. The present invention is especially useful for maintaining or moving in and out of a position with a good vantage point. A camera, microphone, electronic listening or relay device, etc. can move along and/or be secured in suitable positions on cliffs, trees, buildings, etc. using the present invention. The silence and non-marring qualities can be augmented by camouflage to match the surrounding materials so that a good surveillance position can be obtained with low odds of detection.

The present invention can also be used to create various traps. Traps, whether for personnel or equipment, can be based on the present invention. For example, a system mounted in a corner could detect, verify the identity, and disable personnel or equipment. The corner-mounted system might activate other devices surrounding the target or track and paint the target for smart weapons launched or in standby mode. The corner-mounted system might utilize self-contained weapons, tear gas, nets, concussion bombs, skunk (odor) bombs, markers, or other devices. Thus, the present invention can be the basis for a trap and/or a trigger that can be covertly located in an unexpected place.

The present invention can also be used to create an element of surprise during covert operations where no such surprise was previously technologically possible. The present invention's ability to move silently and without marring the surface allows it to aid in a stealth mission or otherwise create an element of surprise. The present invention can move into and out of position without being detected, and it can often do so in plain sight since it is unlikely that anyone would look for the invention in the unexpected, often-inaccessible places it is able to reach. In addition to providing covert information which it could record from its position, the present invention can also be used to attack and/or distract using noise, weapons, gas, liquids, etc. Such as system could aid with causing confusion regarding the origin of an attacker, how an attack was performed or how information was received. Thus, the element of surprise provided by the invention can be used in many ways to achieve advantage over an enemy.

The present invention can also be used in electronic warfare. Existing electronic warfare systems are often very limited in range. The present invention's ability to move around on walls, buildings, cliffs, mountains, etc. quickly and silently would allow it to position and reposition an electronic warfare device to maintain its effectiveness even as a target moves.

The present invention can also be used for communication purposes. Rugged terrain is often a major range-limiting factor for communication systems, many of which rely on line-of-sight types of antennas. The present invention provides a means of rapidly deploying, optimizing and removing a cell phone-like system of antennas, repeaters, transmitters, etc. The invention would also allow light, laser, acoustic, or the physical passing of packages to be performed in a similarly convenient and covert manner.

The present invention can also be used for target marking. Using the technology of the invention, a device stationed in a corner can mark a target using any number of devices including laser markers or a marker delivered as a gas or projectile.

The present invention can also be used for target spotting. The surveillance capability provided allows targets to be seen from angles that, by being in unsuspected locations, may provide easier and more accurate identification and location of a target than were previously possible, because the present invention will allow spotting from previously unreachable locations.

The present invention can also be used for image recognition. Image recognition in a real environment has historically proven itself to be a difficult task. However, the performance of image recognition systems can be enhanced by providing advantageous and/or multiple lighting angles and viewpoints. Multiple lighting angles and viewpoints help to define the three dimensional positions of objects in a scene which allows the otherwise two dimensional patterns to be separated into definite objects. This in turn allows the size and shape of targets to be defined as patterns and recognized as associated with an image that is to be identified. Thus, two or more recognition systems working together could recognize a target much more quickly and reliably than a single system. The mobility of the present invention can create a potentially advantageous positioning capability and can be applied to image recognition based on light, acoustics, radar, etc. The use of light and/or acoustics out of the visible/hearable range provides the ability to perform image recognition in the dark.

COMMERCIAL—The present invention also has a number of commercial uses. For example, it can be used for building maintenance. Many building maintenance tasks, such as cleaning, window washing, painting, repair of caulking, etc. can be performed by one or a team of people or robots located at a corner. Maintenance workers can use a corner clamp to provide increased security on ladders or ropes, or replace these objects with corner climbers. Tasks which previously required scaffolding can also be performed using the present invention.

The present invention can also be used for building inspections. It can provide a means of gripping corners and climbing up, down or along corners to inspect buildings for damage, leaks, etc.

The present invention can also be used for window washing. Aside from alleviating the need for scaffolding, the present invention can also be used to clean windows that were previously almost unreachable. The Jacob Javits Center in New York City, for example, is a glass building with large glass atriums. The interior of the glass can be extremely difficult to clean due to an abundance of truss work on the inside. The present invention can be used to grip features on and around the glass to enable cleaning by a robot or human with less effort that would be required by the use of ropes or scaffolding. The ability to grip the corner between the glass and the frame provides a simple and consistent location for a climbing system. A cleaning system based on such a simple and consistent interface has many advantages over a robot based on holding the truss work, which may vary in position relative to the glass and other structures. For example, the supporting trusses typically are at angles to the glass surfaces so that the spacing between the truss and the glass varies over a wide range. In contrast, the window frame is always adjacent to the window. A robot that grips between the window and window frame can be smaller and simpler than a robot that must deal with the wide variations in spacing and angles associated with a truss structure and its position relative to the glass.

The present invention can also be used for roofing and siding. The corner gripping technology of the present invention can provide convenient and secure safety systems for roofers. A peak grip that will not damage the surface is easy to move and lightweight could prevent many deaths and injuries resulting from the performance of this hazardous activity. The high friction pads developed for use with the present invention could also enhance the safety of shoes and braces currently used in applying roofing and siding.

The present invention can also be used to solve a plethora of other general construction needs. Occasions arise in general construction where clamping materials at a corner (plywood sheathing, etc.) would be useful. A general-purpose clamp that can clamp parallel and at angles and even a mitering fixture which does angle setting and clamping can be developed using the corner clamp technology. For example, two pieces to be mitered at a 90 degree angle can be clamped by pads fixed at a 90 degree angle. The clamp based on the present invention can be located entirely inside or entirely outside the corner formed by such a miter. Existing miter clamps are relatively large and complex since they must clamp from both inside and outside the mitered corner. For very large sheets of plywood in which the joint can be several feet long, a one sided clamp is much more compact and practical than existing clamps. For picture frames with delicate lacy carvings on either the outside or the inside, the ability to clamp a mitered joint securely using only the outside or only the inside edges of the frame is an advantage over existing devices which press on both sides of the frame edges.

The present invention can also be used in advertising. It can be used in laser light shows; it can be used to transport and hold robots bearing ad copy up the inside or outside of buildings. The present invention allows ads to be placed in previously unreachable positions. It also provides a non-marring, portable, low cost alternative to billboards.

The present invention can also be used to hold any other sign, poster, flag or similar item for decorative or identification purposes. Using the present invention, these items can be secured inside or outside of a building without damaging or requiring modification to the surface. It also alleviates the need to have supports jammed in windows for temporary signs and posters hung out of windows.

The present invention can also be used for painting. As with roofing, using the present invention for this activity adds security and will reduce ladder shake (it can also alleviate the need to use a ladder altogether). The present invention can also be used as part of an automated or remote controlled painting system. Using clamping and/or climbing systems on each corner of a wall and/or the wall/eve interface, a tether based painting system could cover an entire wall without the aid of ladders or scaffolding.

The present invention can also be used for emergency escape devices. For example, a high-rise building might be too tall for a rope or ladder to be used as an escape mechanism. Most buildings do have an inside or outside corner or similar features. One or more corner grippers (possibly combined with a shorter rope or ladder) could be used by a human to descend from a dangerous situation on a high floor.

The present invention can also be used by firefighters and police in rescue operations. The ability to quickly attach and remove grippers to different building features, including corners, can greatly aid in rescue efforts where additional leverage, support or safety backup is desired, especially if such an ability is integrated into one light weight and compact device.

Industrial—The present invention can also be used in a variety of industrial settings. One use is clamping. Clamping mitered frames can be performed with this invention without damaging finishes or material. This enables much simpler fabrication and repair of picture frames, for example. Existing clamps for mitering are bulky and can damage surface finishes. Machinists often use double-sided sticky tape to secure objects to be machined. The corner clamp could allow many such time-consuming fixture-related tasks to be replaced with a clamping system and might also aid in assembly operations by allowing non-parallel surfaces to be used for clamping. Currently, clamping non-parallel surfaces and even parallel surfaces, especially while gluing, can be a problem because motion can occur. Clamps based on the high grip material allow the position of the materials to be maintained securely while clamping and while the glue sets.

The present invention can also be used to clamp surfaces together in a temporary manner. Temporary structures can be clamped together. It would be difficult and require special features to deal with the corners in clamped-together structures using the technology disclosed in the prior art. With the present invention, it is possible to clamp plywood together in the corners to make a box without fasteners or special features.

Household—The present invention can also be used for a number of household activities. For example, the corner clamp of the present invention can be used for bathroom and shower racks. Because the clamps are movable, the shelves can continually be placed in new, convenient locations. Many of the racks on the market hang from showerheads, a bath fixture or are held by suction cups. The present invention can be placed in many places relative to the showerhead, and can grip surfaces that are not easily gripped by suction cups.

The present invention can also be used to hold decorative hangings. The present invention can be used to hold curtains without marring the wall and without the use of attachments. It can also be used to hang pictures or other wall hangings. Using adjacent or opposite walls, the present invention could be used to place partitions within a room.

The present invention can also be used to hang fixtures or assist with remodeling experiments. Lights, bookshelves, party decorations, etc. can be supported by the invention. During a remodeling effort, test sheets can be hung from these clamps to see if a color, texture or pattern is desirable in the actual room environment.

The present invention can also be used to secure televisions, computer screens or other components to a corner. It can be used to change the position of these items easily. For example, a monitor or television could be positioned in a corner at a height suitable for a child, and then raised later that day for use by an adult, or adjusted over time as the child grows.

Recreational—The present invention can also be used for a number of recreational activities. Rock climbing, for example, is generally based on using primarily human support for all of the climbing, while mechanical anchoring devices are used for security in case of a fall. Currently, the most secure anchors are drilled and bolted hangars, which permanently deface the rock, are a hazard to bump into, and can become dangerous as they age. The present invention can be used to supplement or replace many of the existing rock climbing safety systems, and it also has the added benefits of being quick to place and remove, and it is non-marring.

The present invention can also be used in mountaineering. Mountaineering most often utilizes assisted climbing, where an apparatus is relied on for actual climbing and not just for backup. The present invention can be used to replace the existing apparatuses, which are unsightly, heavy, slow, and often utilize single-use pitons and require drilling and bolting. In contrast, the present invention is lightweight, quickly engaged and disengaged, reusable, and utilizes non-marking and non marring grippers.

The present invention can also be used for gear hauling. In mountaineering, river rafting, and elsewhere, providing a secure clamp for mounting a pulley, securing platforms, or for hauling gear up or down is a useful capability. The present invention can be used on many features for which no other gripping technology will work and can be used to supplement grips where conventional grips can be used.

The present invention can also be used for roof racks. The non-marring clamping capabilities make the present invention ideal for securing gear on vehicles. Most current roof racks and storage systems must be permanently attached to the vehicle, and installing them can also be difficult and time consuming. The present invention alleviates these concerns because it is not permanent and does not require installation.

The present invention can also act as a research tool. Researchers may use the device for their research activities involving the study of cliff living organisms, or might perform research on materials, clamping, and friction using apparatus based on those of the present invention or with the intent of improving on the present invention.

Toys and Games—The present invention has wide applicability in the area of toys and games. The clamps can be used to suspend toys in corners and on walls by direct adhesion or support them in space or along walls using two or more corner devices in different corners connected or communicating in some way. The present invention could be used to create a toy that jumps from wall to wall to climb, like Jackie Chan in Rumble in the Bronx. The present invention can be used to make toys that are thrown or aimed at the wall, as well as toys and games that integrate skill, chance, and technology. For example, a toy that, when thrown at a corner, springs upwards some distance depending on the speed and angle of impact making one or more impacts with adjacent wall surfaces could be created. Apparatuses for holding targets such as dart boards, basketball hoops, baseball batters and/or catcher's mitts, golf game targets, nets or targets for projectiles, helicopter landing pads, "enemy" targets such as a toy figure(s), aircraft, etc. could also be created using this technology.

The present invention can also be used in creating action figures or action figure accessories. The ability to grip corners, poles, other toys, etc. provided by the invention enables action figures to perform feats that cannot be performed in any other way without marring surfaces. Some of the friction materials used with the present invention provide enough adhesive-like grip that even some flat surfaces could be gripped. Action figures such as Spiderman, Batman, their machines and enemies, etc. can be made to cling to walls, roost in corners, cling to doors, attach to other toys, etc. The corner clinging (or climbing) features of the present invention can be built into the toy, or integrated with accessories such as clothing, exoskeletons, etc. Corner clamps could deploy nets, projectiles, or ropes for action games. Such toys could be positioned by hand or be actuated to provide climbing or other capabilities. Examples of toys based on the invention include figures that cling to a corner and then jump off, parachute down, hang glide down, shoot light beams or the like. Wheeled climbers could be made into Matchbox™ type toy vehicles that can roll on corners, and using the adhesive properties of some of the materials, can even roll down vertical surfaces or possibly cling to ceilings. More sophisticated toys could also be made to climb or descend robotically and could be controlled manually or by radio, voice, or light control.

In addition to the primarily toy/action figure uses just described, games can be based on the present invention. For example, a device such as a ball could be thrown at or bounced at a corner and points scored based on how many bounces occurred or if and for how long the device stuck and stayed in the corner. The device could have facets or be spring-loaded or even use control systems to provide an enhanced mix of luck and skill to the game.

The present invention can also be used to create racing toys. Corner climbing cars, insects, etc. could be raced over a surface, up corners, and around rooms.

This invention will also allow "super powers" of movie, television and comic book characters to be more accurately reproduced in the accompanying toys and games.

Most toy applications can be envisioned as robots. Often there is potential for a low cost toy based on manual operation and a higher priced toy with one or more robotic features. The present invention can be easily used to create both types of toys.

Miscellaneous Uses—The present invention is not limited to the uses described herein. It can be used wherever a need for a clamping and/or climbing device exists.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 2 depicts a fluid, gel, or air-bladder pad for use with the present invention.

FIG. 3 depicts a ribbed pad for use with the present invention.

FIG. 4 depicts a ring pad for use with the present invention.

FIG. 20A depicts a perspective view of a human-operated outside corner climber in accordance with the present invention.

FIG. 20B depicts a top view of the outside corner climber shown in FIG. 20A.

DETAILED DESCRIPTION OF PREFERRED EMBODIMENTS

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention.

Certain terminology will be used in the following description for convenience in reference only and will not be limiting. The words "in" and "out" will refer to directions toward and away from, respectively, the geometric center of the device and designated and/or referenced parts thereof. The words "up" and "down" will indicate directions relative to the horizontal and as depicted in the various figures. The words "clockwise" and "counterclockwise" will indicate rotation relative to a standard "right-handed" coordinate system. Such terminology will include the words above specifically mentioned, derivatives thereof and words of similar import.

Embodiments of the present invention comprise devices that are capable of climbing surfaces that are at various angles to each other. In fact, the present invention can climb corners wherein two surface meet at right, or even more adverse angles. Furthermore, the present invention is capable of climbing a variety of different surfaces including, but not limited to, pillars, trees, cliffs, poles, etc.

Figure 1:
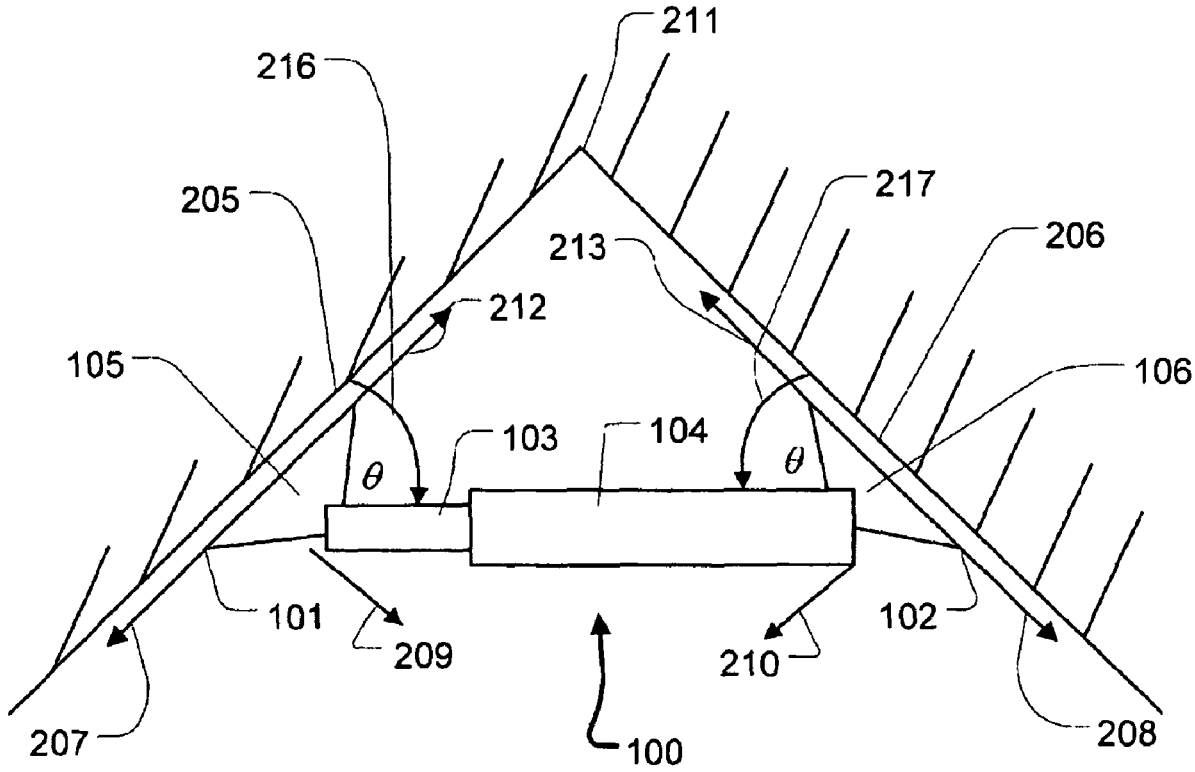
FIG. 1 depicts a corner climber tube clamp as it is aligned or positioned within an inside corner.

Referring first to FIG. 1, shown is an corner climber tube clamp 100 placed inside a corner. Inner and outer tubes 103 and 104 of corner climber tube clamp 100 can extend until pads 101 and 102 contact surfaces 205 and 206. The friction between the pads 101 and surface 205 and between pad 102 and surface 206 prevents the inside corner tube clamp 100 from slipping out of corner 211. Joints 105 and 106 allow pads 101 and 102 to adjust to the angle of surfaces 205 and 206 such that pads 101 and 102 are flush with surfaces 205 and 206, respectively. However, the system necessitates a minimum coefficient of friction for pads 101 and 102. In order to determine the minimum coefficient of friction, the individual force components must be analyzed. The outward force created by the extension of inner and outer tubes 103 and 104 can be broken into two separate vector components for each of the surfaces 205 and 206. One component is directed orthogonally into surfaces 205 and 206. Naturally, surfaces 205 and 206 respond by exhibiting an equal and opposite normal force illustrated in FIG. 1 by vectors 209 and 210. The second component is directed away from corner 211 parallel to surfaces 205 and 206. These forces are illustrated in FIG. 1 by vectors 207 and 208. The corresponding frictional forces, represented in FIG. 1 by vectors 212 and 213, oppose forces 207 and 208. In order to prevent the pads 101 and 102 from slipping away from the corner 211 thereby causing corner climber tube clamp 100 to become dislodged, the coefficient of friction must be great enough such that the magnitudes forces 212 and 213 are greater than or equal to the magnitudes of forces 207 and 208, respectively. The magnitude of the force of friction is represented by the following equation: $F_F=\mu F_N$ wherein $\mu$ is the coefficient of friction of pads 101 and 102 and $F_N$ is the normal force (shown in FIG. 1 as vectors 209 and 210. Simple vector analysis demonstrates that the normal force, $F_N$, equals $F_o \sin(\theta)$ wherein $F_o$ is the outward force generated by corner tube clamp 100 and $\theta$ is the angle between the surface 205 or 206 and inner and outer tubes 103 and 104. This angle $\theta$ is shown in FIG. 1 by arrows 216 or 217. Further, simple vector analysis shows that the magnitudes of forces 207 and 208 equal $F_o \cos(\theta)$. At the very minimum, the magnitude of $F_F$ must equal the magnitude of forces 207 and 208. Thus, $F_F=\mu F_o \sin(\theta) \geqq F_o \cos(\theta)$, which means that $\mu \geqq \text{cotan}(\theta)$. Therefore, the coefficient of friction must be greater than or equal to the cotangent of $\theta$, (or greater than or equal to the tangent of one half of the angle between the two walls) the angle between the corner tube clamp 100 and surfaces 205 and 206. Under the assumption that surfaces 205 and 206 are orthogonal and the angle $\theta$ on both ends of corner tube clamp 100 is the same, i.e., $\theta=45°$ or $\pi/4$, $\mu \geqq \text{cotan}(\pi/4)=1$. Thus, $\mu$ must be greater than or equal to 1 in order to prevent corner tube clamp 100 from slipping from corner 211 if created by two orthogonal surfaces. Of course, it is possible that the angle between corner climber clamp 100 and surface 205 is different from the angle between corner climber tube clamp 100 and surface 206. In this case, the smaller angle should be used to determine the minimum coefficient of friction.

FIG. 1 illustrate the corner climber being applied to flat surfaces. However, the corner climber is not limited to flat surfaces, but rather, may be used on concave, convex, flat, curved, rounded, bumpy, and/or multi-angled surfaces at any angle relative to gravity. The present invention may also be used in space-based applications and/or underwater applications wherein gravity is not the primary force of interest. Similarly, other applications such as machining fixtures and gluing clamps might involve conditions where forces other than gravity are the primary reaction forces involved with clamping. Orthogonal corners are generally used herein for exemplary purposes because of their commonality and convenience. However, embodiments of the present invention may operate on corners of lesser and/or greater angles, provided a sufficient coefficient of friction or sufficient adhesion between the friction pads and surfaces is achieved. As mathematically shown above, the minimum coefficient for an inside corner climber climbing orthogonal surfaces is 1. As the angle between the surfaces increases (i.e., greater than 90°), the minimum coefficient of friction becomes greater. Conversely, as the angle between the surfaces decreases (i.e., less than 90°), the minimum coefficient of friction becomes lower. When materials produce adhesive and/or suction forces instead of or in addition to frictional forces, the required frictional and clamp forces can be reduced. Many of the high friction materials also have adhesive properties that sometimes allow the clamping force to be eliminated and adhesion to be achieved.

Some materials necessary for creating such high coefficients of friction against materials commonly used for surfaces such as walls are disclosed in the U.K. patent GB2131475 by Crabbe, all of which is incorporated herein by reference. Herein, Crabbe utilizes polyurethane foams and other foam plastics and rubbers having similar properties on hard mineral surfaces. Crabbe reports coefficients of friction of up to 1.5 for such materials. However, the materials disclosed in Crabbe are not particularly suitable for very smooth surfaces. Thus, improved high friction materials are necessary. The following readily available materials may be used for the friction pads of the present invention: Dycem®, Versaflex®, Dynaflex®, Kraton™, Versalloy®, TEEBAUD®, Five-Ten Stealth rubber, etc.

Dycem®, produced by Dycem® Limited provides products constructed of polyester plasticizers and polymeric compositions manufactured through an emulsion process. Dycem® is a polyester composite PVC compound with non-migratory plasticizers. Further, Dycem® may be cleaned with soapy water. Other materials manufactured by the GLS Corporation (GLS) include Versaflex® (referred to herein as "CL-30"), Dynaflex® (contains KRATON™ polymers), Kraton™, and Versalloy®. According to GLS literature, these materials consist of thermoplastic elastomer compounds (referred to herein as "TPE"). TPE's are generally lower modulus, flexible materials that can be stretched repeatedly to at least twice their original length at room temperature without permanent deformation. Dycem® and GLS products have demonstrated coefficients of friction of greater than 1 on a variety of surfaces such as painted wood, brick, wallboard, smooth plywood, glass, and concrete. For some combinations of materials, friction coefficients greater than 2 or even releasable, repeatable adhesive gripping has been demonstrated. For these Dycem and GLS materials, performance is optimal on clean surfaces, however, it has been shown to be adequate on dusty surfaces. Further, these materials are easily cleaned with water.

Another material that may be used with the present invention is TEEBAUD®, a product of Teebaud® Co. L.L.C. TEEBAUD® is a fiber mat with a water-based clean lift adhesive treatment. This, as well as Five-Ten Stealth and Stealth C4 rubber, available in resole kits for mountain climbing shoes, demonstrated sufficiently high coefficients of friction. Five-Ten Stealth rubber is designed for mountain climbing and is consequently very tough and tear resistant. Other climbing sole materials may also be utilized in the present invention.

Additional materials and/or devices may be used for damp or wet surfaces, for example, Five-Ten makes a special rubber for gripping wet surfaces such as rocky stream beds. Moreover, numerous other physical effects that generate forces may also be utilized. These effects include, but are not limited to static electricity, intermolecular forces, Vanderwall's force, adhesives (e.g. the adhesive of Post-It® Note), suction (e.g. suction cups), hooks, foot pads (like on geckos), slime (like slugs or bacteria), surface cleaners and/or adhesives, and/or any other or similar friction technology. Hooks, especially micro-hooks based on Micro Electro Mechanical System (MEMS) technology, also have applications to high friction gripping. That is, even apparently smooth surfaces look like numerous corners at MEMS the scale. A device on this scale would be able to climb a seemingly flat wall. MEMS technology may also provide a high friction capability for larger devices when used in the manufacture of friction pads. MEMS scale technology may also provide a means of reducing or eliminating creep.

Just as the material used to create the friction pads is important, the pad design also has significant effects on the performance of the present invention. Specifically, pad loading is an important concept to consider when designing friction pads. Generally, the coefficient of friction is not constant along the entire surface of a material. Rather, it is dependent on the pad pressure and load conditions. Flexibility and limited strength of high friction materials further complicates the problem. Under heavy loads, the coefficient of friction may drop and shear forces may damage the material.

A variety of design solutions are available to maximize the effectiveness of high friction materials. For example, rounded surface pads, which operate especially well with stiff joints, may be employed since they can accommodate a wide range of angles to the surface. Also, flat pads mounted on flexible or pivoting joints are also useful to accommodate various surface angles. These flat pads are also suited to higher loads when the friction material effectiveness is reduced by high pressures and/or shear forces. Flat or conformal pads allow the force to be more spread out because providing a large area reduces stress on the pad. Other features may be adjusted in order to optimize performance, such as thickness, stiffness, and conformability of the pad. For example, with Dycem® thinner and thicker pads performed better with smooth surfaces and high forces, respectively, in preventing point loading, tearing, and pad damage.

Furthermore, pads may be mounted on materials that are stiff or conformal. In one instance, a foam layer of Dycem® has been used to provide compliance with a thin layer of solid Dycem® material in demonstration devices. A thicker multiple layered pad of solid Dycem® can also be used. (The multiple layered pads can be peeled so that a damaged layer can be removed to expose fresh material). Such materials can be co-molded with a base material or simply glued to the base material. For instance, cyanoacrilate glue has been used in demonstration devices. These materials hold well when the contact surface area is high and the contact stress is low. A thicker pad with high compliance accommodates peak heights of rough surfaces well. If the peaks are not well accommodated, overstressing at the point of peak loading will tear the grip material of the pad.

Moreover, for many materials, the coefficient of friction falls to lower values at high stress conditions. Thus, for many materials pads should be designed to distribute loads optimally thereby minimizing peak stress and maximizing contact area. Some pad materials have an optimum pressure to achieve maximum friction, so the pressure and area must be matched to the task. Pad features such as camber that make the load more uniform may be advantageous. Creep behavior is also dependent on pad load distribution, edge conditions, and other details of design.

Multiple pad systems that may be supported on one or more a pivoting trusses may also prove useful for uneven surfaces. This is because each pad can contact appropriately to its corresponding surface such that the contacted surface area is maximized or optimized.

Referring now to FIG. 2, illustrated is one of many possible pad configurations for use with a corner climber in accordance with the present invention. Here, pillow pad 600 which is attached to the end of pivot arm 604 is depicted having high friction grip material 601 on its surface. High grip material 601 may include a reinforced backing 602, and is typically mounted in a gas tight (and/or fluid tight) manner forming a type of gas pillow. Pillow pad 600 produces a relatively uniform surface contact pressure when applied against a surface. Gas, fluid, foam, gel, structural components, suspension components, and/or phase change material alone or in combination may be used. Further, pillow pad 600 may be compartmentalized such that each pad contains a plurality of airtight sections. This design allows the pressure distribution of pillow pad 600 to be controlled, thereby providing enhanced tolerance to damage. The design of pillow pad 600 may be applied to most of the alternative friction pad embodiments.

Turning next to FIG. 3, shown is another pad design having ribbed structure. Specifically, the pad may consist of strips and/or bumps 701 instead a single smooth surface. Any number of such strips or bumps 701 may be used on a given pad 700 depending on their size as well as the site of pad 700. This allows the force to be applied in any direction. Further, strips or bumps 701 may be solid, layered, composite, or fluid filled, and each may also be segmented in individually controlled compartments, as previously described. Other designs, such as a series of rings, non-linear strips, round, or rectangular bumps, etc., may also be employed.

Yet another design is shown in FIG. 4. Here, concentric pad 800 is depicted having a series of concentric rings 801. Such configuration may also act as a suction cup during use. A feathered edge and/or a gel may be added around or even oozed or pumped from the perimeter of the pad to provide a better seal between pad 800 and the surface. Generally, the shape of concentric pad 800 (i.e., similar to that of a suction cup) is also suited to distribute force from a mounting point to a large area including the perimeter. Consequently, it well suited for high friction gripping. Of course, a variety of shapes may be used. Circular or concentric is preferred. Moreover, such a suction cup design can provide enhanced capability in some situations. That is, when suction cups are on a surface that provides good suction, the clamp force may be reduced or even eliminated. Because clamp force contributes to creep, its reduction or elimination can in turn reduce or eliminate creep. Also, the clamp force may be applied intermittently to recompress the suction cup-action thereby further reducing the creep rate and power requirement. Another benefit of this design is that if creep motion takes the clamp mechanism into a position where clamp force alone is insufficient to maintain grip, then the suction cups can supplement the clamp force and maintain the grip. Other common shapes of suction cups, not shown in the figures, are well known in the art and therefore, are within the scope of the present invention.

Figure 5:
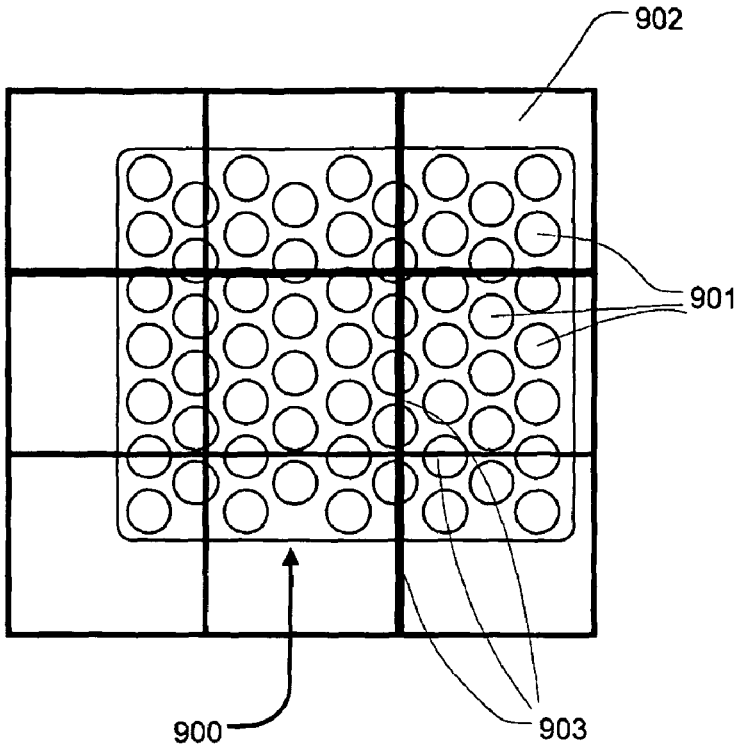
FIG. 5 depicts a patterned suction cup "octopus" grip pad for use with the present invention.

In addition to having the pad in the form of a typical single suction cup, an alternative design may comprise several suction cups like an octopus arm. FIG. 5 depicts such a multiple suction cup pad 900 having multiple suction cups 901 on the pad surface. Even though suction cups 901 can be defeated by rough surfaces, they work well on smooth surfaces. Such a design is advantageous because even though individual suction cups 901 may be defeated on interrupted smooth surfaces such as tiled surface 902 at, for example, tile joints 903, the pattern spacing is configured so that even if some suction cups 901 are positioned at tile joints 903, other suction cups 901 are on the smooth section of tile surface 902 where good suction is maintained. In addition, the particular suction cups 901 that are positioned at joints 903 may provide an improved effective wall angle, which may also enhance grip. When suction cups 901 work well, there is also the potential to grip and move on surfaces with corners that are too widely angled for normal operation or even on surfaces without corners. For example, a climber could grip and/or traverse flat glass surfaces. There are many variations in friction pad design and friction pad surface patterning including suction cups 901 of various shapes, sizes and patterns and directional and non-directional patterns with other functions. Suction cups 901 and/or suction cup shaped pads may be configured from most of the high friction materials disclosed herein.

Some of those high friction materials exhibit peelable adhesive gripping behavior on smooth surfaces. For example, CL-30 friction material (from GLS Corp.) in contact with glass, or some other smooth surface such as Plexiglas™, and smooth fiberglass structures may be placed or rolled onto the surface and maintain grip force without requiring a normal force. Thus, gripping and climbing capabilities based on an adhesive like grip may be achieved with or without the use of suction cup features. A rolling pad configuration based on such material interactions might allow for the climbing of smooth surfaces, flat surfaces, as well as on corner like structures.

Figure 6:
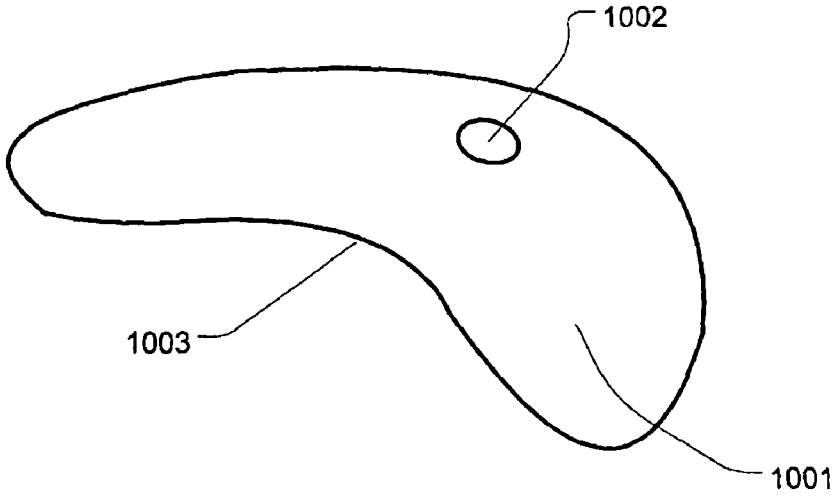
FIG. 6 depicts a boomerang shaped pad for use with the present invention.

Another configuration for a friction pad is depicted in FIG. 6, which shows boomerang shaped pad 1001. Also shown is the primary direction of force 1002 for optimum performance of boomerang pad 1001. The surface of pad 1001 preferably provides a type of camber 1003 to assist in load distribution by spreading the load more evenly to the outer span of pad 1001. Again, any of the high friction materials described herein may be used for the surface of boomerang pad 1001.

Figure 7A:
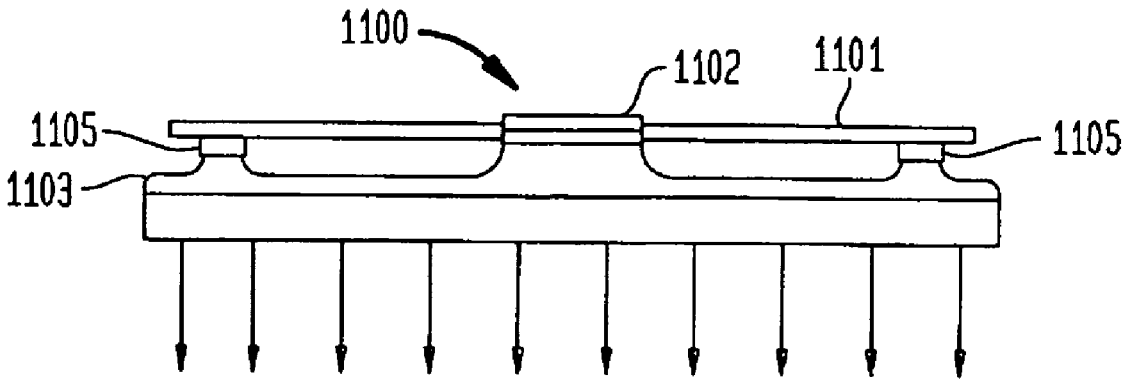
FIGS. 7A and 7B depict side and perspective views, respectively, of a controlled camber pad for use with the present invention.
Figure 7B:
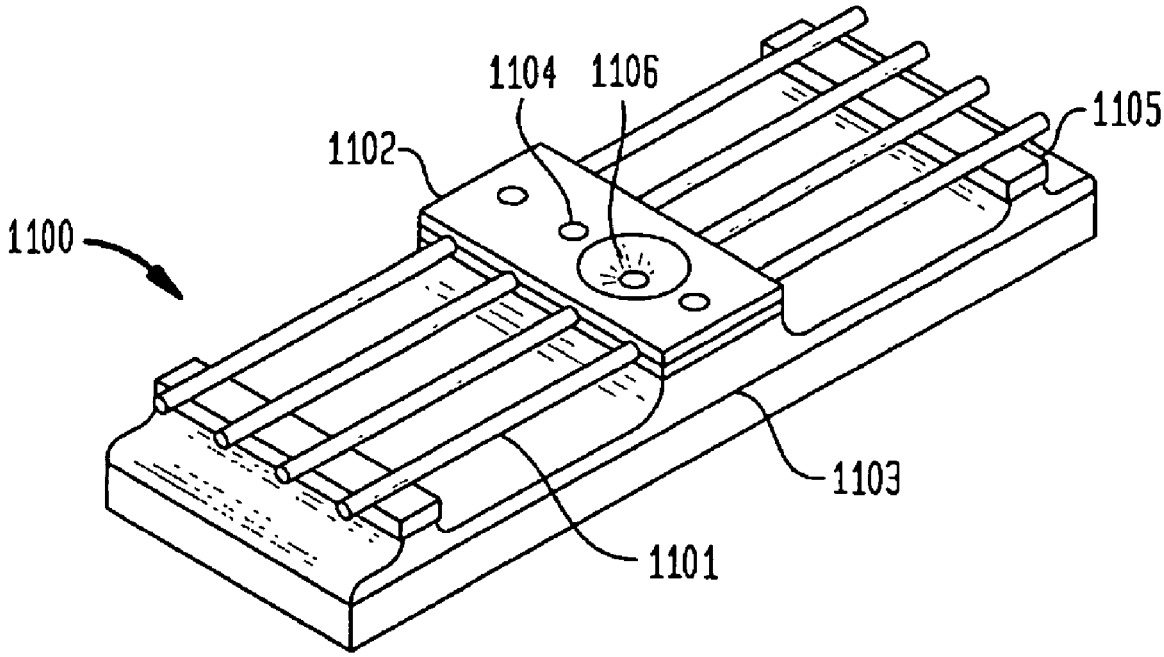

Turning next to FIGS. 7A-7B, shown is a controlled camber inducer pad 1100. As shown, controlled camber inducer pad 1100 comprises a base 1103, spring retainer 1102, camber springs 1101, and pressure wedges 1105. Camber springs 1101 are mounted in spring retainer 1102, which is in turn mounted to pad base 1103 pressure screw 1104. Of course, other types of fasteners may be used to secure spring retainer 1102 to pad base 1103. During use, camber springs 1101 press on pressure wedges 1105 which put pressure on the ends of pad base 1103 to induce camber. A pad pivot 1106 is positioned offset from the center of the pad, as shown.

Operation of controlled camber inducer pad 1100 is achieved by utilization of the pressure screw 1104 and pressure wedges 1105. That is, spring force may be adjusted to control the pressure distribution of pad 1100 when pad 1100 is clamped to a surface by applying pressure at the pad pivot location 1106. Typically, the object is to increase the uniformity of the pad pressure by taking advantage of the force of camber springs 1101 on the pressure wedges 1105. The pad pivot 1106 is preferably located towards the trailing edge of pad 1100 such that the net force on pad 1100 acts through or near the center of the contact surface area. Therefore, the pressure distribution on pad 1100 may be made more uniform from the leading to the trailing edge, as well as from end to end. Once again, any of the high friction materials described herein or found or developed at a later date may be used as the surface of pad 1100.

Many embodiments of the controlled camber inducer pad 1100 may be employed. Such alternative embodiments include a combination of one or more aspects of both cambered/spring pad 1100 and pressure the distribution features of boomerang curved pad 1001 (FIG. 6). For example, any number camber springs (or even none) may be utilized in accordance with the invention. Also, camber springs 1101 may contact one or more wedges 1105 or even one or multiple locations directly on pad base 1103. Moreover, camber springs 1101 may be of various sizes and shapes and materials. For example, pad 1100 may include an octopus like array of camber springs 1101 putting pressure on pad base 1103 which may comprise a plurality of suction cup portions. Preferably, camber springs 1101 would put pressure on each suction cup portion of pad 1100. Optionally, camber springs 1101 may be attached to individual pads. Further rather than utilize "springs", pad 1100 may be curved such that the inherent elasticity of the friction material on the surface of pad 1100 and its backing combined with stiffness of pad base 1103 provides improved load distribution. There are also many different structural configurations that may be employed to distribute the pressure in a variety of multiple directions and utilize controllable shape members to vary the pressure distribution on the pads as required. For example, suction cup shaped pad may be made to include such load distributing features. It is also possible to construct the pad in a non-uniform shape or thickness and/or to pressurize portions of the pad so that distribution of the force on the pad may be optimized.

Figure 8:
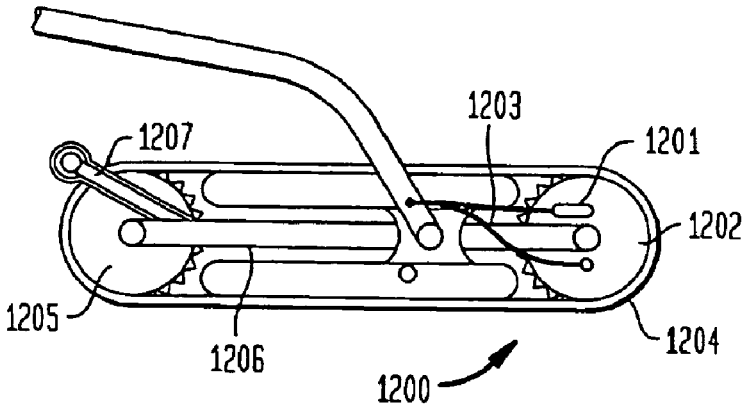
FIG. 8 depicts a track/belt pad for use with the present invention.

Still another type of pad that may be used in accordance with the invention is shown in FIG. 8. Specifically, shown is a belt/track type pad 1200 comprising high friction belt 1204, right and left drums 1202 and 1205, and connecting rod 1206. Pad 1200 may incorporate drive system and/or cleaning system 1207. A gear motor 1201 may be employed internal to right drum 1202 to control such drive and/or cleaning system 1207. A driven pad of this type may obviate creep and/or the need for a multiple clamp drive system. Such a system may be deployed alone, on each pad, or multiple systems on each pad to provide steering, etc. In addition to drive and/or cleaning system 1207, a friction enhancer and/or adhesive application system may be incorporated. Such a system may be used on wheels or modified for use on pads as well. Further, adding a rotation control actuator on belt/track track pad 1200 of FIG. 8 to control the angle of pad 1200 on wall surface to the drive system would provide an improved means of traveling, obtaining clamp force, and of minimizing creep. Yet again, any of the high friction materials described herein may be used as the surface of belt 1204 of belt/track pad 1200.

Figure 9A:
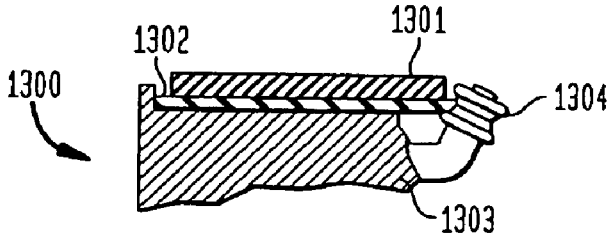
FIG. 9A depicts a cross section of a reinforced belt pad with a side roller for use with the present invention.

Next, FIG. 9A shows a cross-section of a reinforced belt drive pad 1300 with a side roller 1304 where the grip material 1301 is backed by belt 1302 for reinforcement which slides along base surface 1303 of low friction. If a thin metal belt is used, then one ore more side-rollers 1304 may be used to help distribute the force on grip 1301 along the entire span of the belt 1302. Once again, any of the high friction materials described herein may be used as the surface of belt 1304/track pad 1300.

Figure 9B:
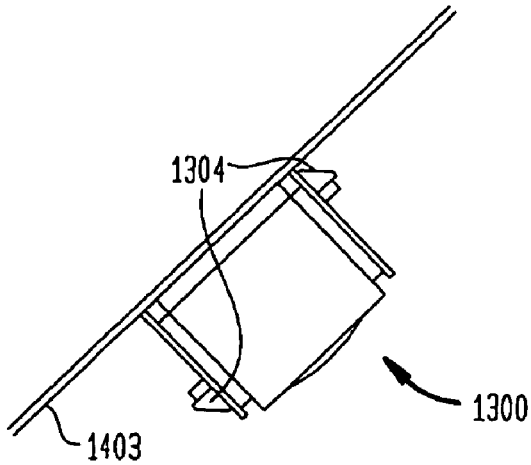
FIG. 9B depicts a top view of a reinforced belt pad and side roller system for use with the present invention.

Looking at FIG. 9B, shown is a top view of the embodiment of belt drive 1300 as used on a wall 1403 of an inside corner. The side rollers 1304 are positioned diagonally opposite one another in this embodiment so that an outside corner may be gripped merely by turning belt drive 1300 around. Alternatively or in combination, rollers 1304 may be mounted on opposite edges of the belt so that the same surface may be used on either an inside or an outside corner. Further, a round belt or half round belt or some other shape, with or without teeth may be used with the appropriate roller and/or slider shapes in accordance with the invention.

Figure 10:
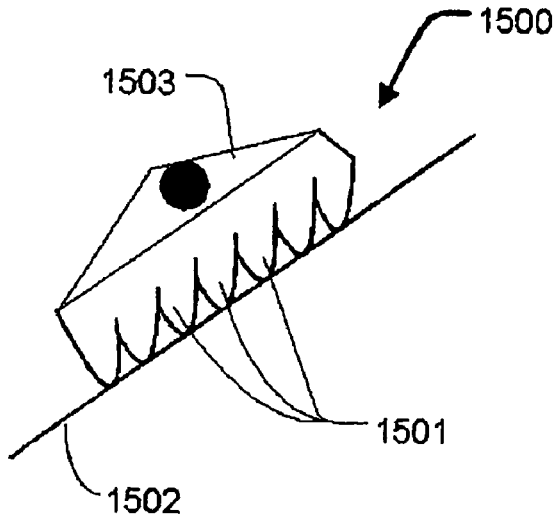
FIG. 10 depicts a side view of a vibrating traveling pad for use with the present invention.

Referring next to FIG. 10, shown is friction pad 1500 having angled pad elements 1501 that, when vibrated, cause pad 1500 to travel along surface 1502. Such pad 1500, combined with a vibration control device (not shown) may be used to climb, descend, and/or regrip a surface to minimize creep.

Of course, any of the high friction materials described herein may be used for angled pad elements 1501. Further, angled pad elements may take the form of any number of previously described shapes and sizes or be fabricated of a mix of or layers of materials. The vibration control device. (not shown) may be contained within base 1503 of pad 1500 to individually vibrate each of pad elements 1501, or may be provided as a separate component to cause the vibration of the entire pad 1500. In either event, such devices to control the vibration of pad 1500 or pad elements 1501 are know to a person of skill in the art.

The edge conditions are important considerations in the pad. High shear stress and loading at the edge can lead to reduced friction, increased creep, rapid wear, and/or peeling. In general, any pad contact points that do not achieve high friction on the surface contribute adversely to the performance of the device. When the pads are mounted on flexible joints, the location of the effective center of rotation is an important consideration. For example, a ball joint pivot must be close to the surface so that an overturning moment does not cause the pad to flip onto its edge or overload the leading edge.

Figure 11:
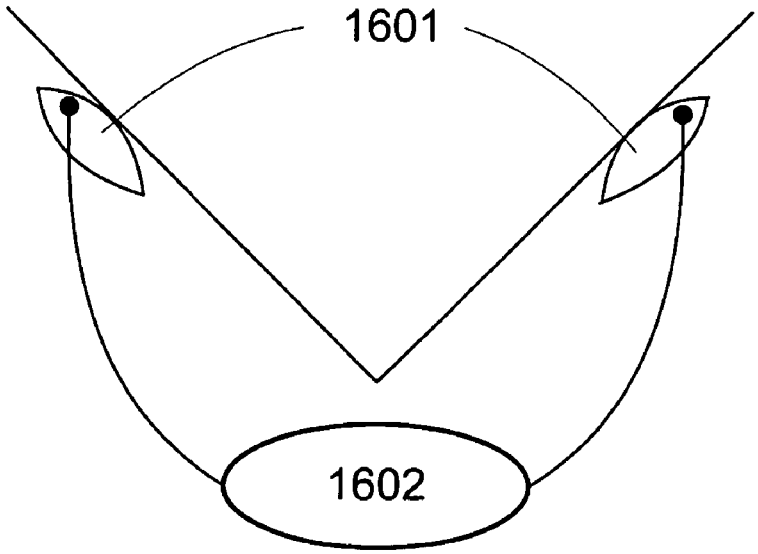
FIG. 11 depicts a top view of vibrating regripping pads for use with the preferred embodiment of the present invention.

Similarly, the pad 1601 and pivot 1602 embodiment shown in FIG. 11, when vibrated, also provides moving/regripping capability thereby allowing such a device to climb corners. There are many variations on these approaches to pad design that a person of ordinary skill in the art would appreciate and would consider within the scope of the present invention.

Edge conditions are important considerations in any pad configuration. High shear stress and loading at the edge can lead to reduced friction, increased creep, rapid wear, and/or peeling. In general, any friction pad contact points that do not achieve high friction on the surface contribute adversely to the performance of the climbing device. When the friction pads are mounted on flexible joints, the location of the effective center of rotation is an important consideration. For example, a ball joint pivot must be close to the surface so that an overturning moment does not cause the friction pad to flip onto its edge or overload the leading edge.

Figure 12:
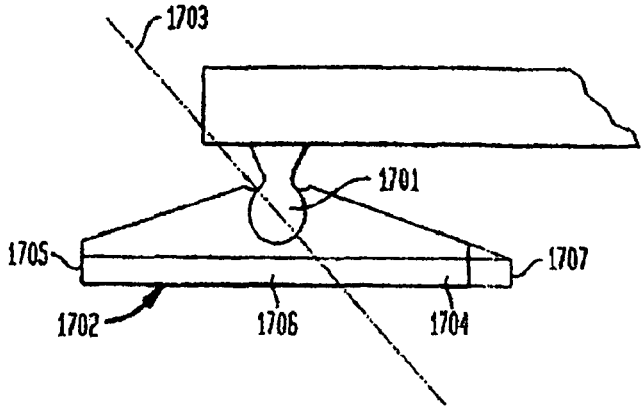
FIG. 12 depicts a side view of a ball joint and pad for use with the present invention.

For example, FIG. 12 shows a successfully used ball joint 1701 and friction pad 1706. As shown, ball joint 1701 is located close to the pad surface 1702. The angled line 1703 in FIG. 12 shows the typical line of action of the major force on pad 1706 when in use. Note that loading along that line tends to generate a moment and load leading edge 1704 of the pad more highly than middle or trailing edge 1705. To compensate for this uneven load distribution, friction pad 1706 may comprise an extended pad leading edge 1707. In some cases, the ball joint 1701 is positioned such that the location of the center of pressure on friction pad 1706 is in front of the center of rotation of the ball joint 1701. Because pad 1706 is generally large and the coefficient of friction high, there is little tendency for pad 1706 to rotate even when there are sources of off center loading, such as surface roughness.

Figure 13A:
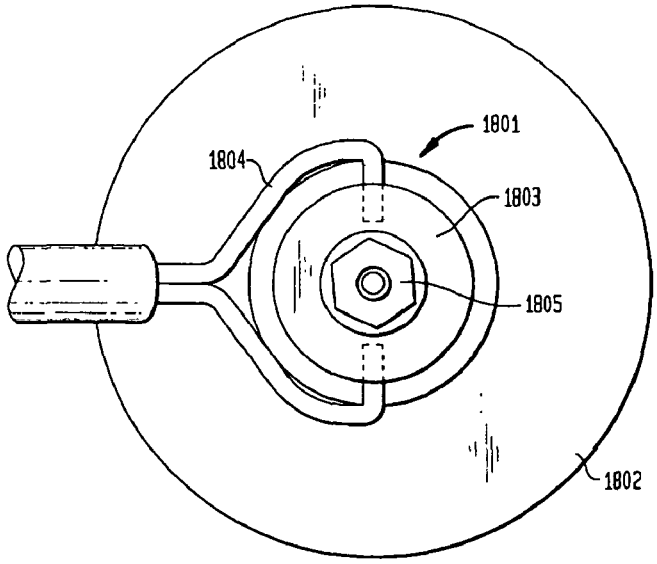
FIG. 13A depicts a top view of a swivel joint with pad for use with the present invention.
Figure 13B:
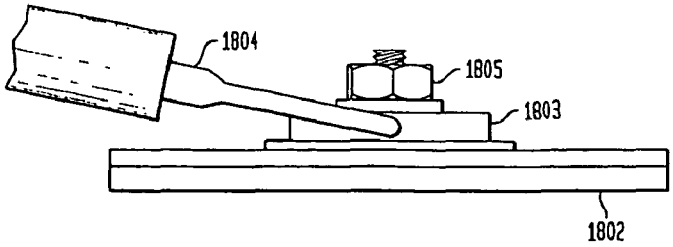
FIG. 13B depicts a side view of a swivel joint with pad for use with the present invention.

Referring next to FIGS. 13A and 13B shown are top and side views, respectively, of an alternative joint device to the ball joint mounted pad of FIG. 12. Here, pad 1802 is attached to swivel joint 1801 which comprises a rotatable disk 1803 slidably engaged with pad 1802, in a circular direction. Disk 1803 preferably comprises openings for attaching one end of actuator arm 1804 such that it provides a pivoting motion of pad 1802. Further, disk 1803 is fastened to pad 1802 preferably with nut and bolt fasteners 1805. Of course other fasteners may be used. It has similar characteristics as the fully pivoted pad. An advantage of this pad design is the ability to rotate over a much larger angle than the ball joint of FIG. 12. Pad 1802 may be flipped completely over which allows simple switching from inside to outside corners. Further, one or more degrees of freedom may be eliminated from the swivel joint 1801 to simplify its construction. Also, the position of pad 1802 when unloaded may be maintained by a spring or springs (not shown) utilizing slight intentional misalignment of the pivot axis, by detents in the pivots, by foam pads, by springs, etc. Again, the surface of pad 1802 may take any size, shape and/or form, including any of the high friction materials, as described for any of the embodiments disclosed herein.

Figure 14:
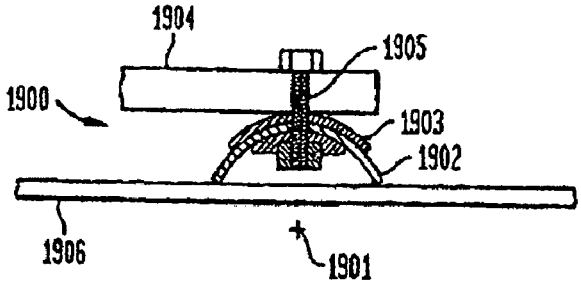
FIG. 14 depicts a side view of a remote center ball joint for pads for use with the present invention.
Figure 15:
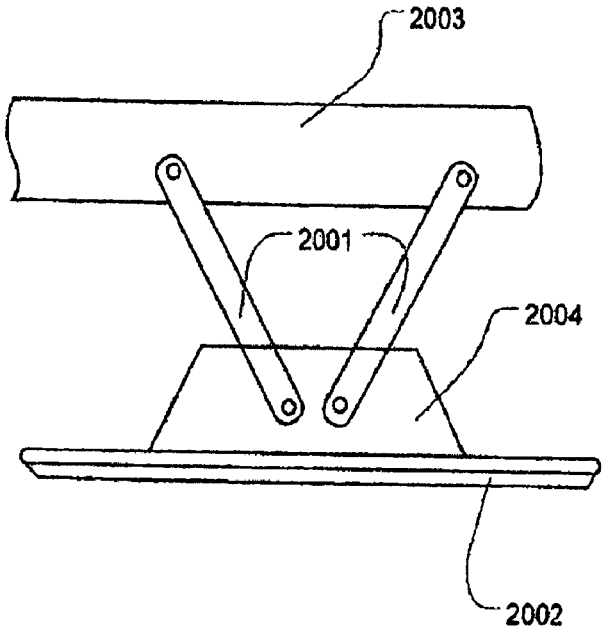
FIG. 15 depicts a side view of remote center linkage for use with the present invention.

Also in accordance with the present invention, joint designs that use remote center geometries such as those shown in FIG. 14 and FIG. 15 may be used. In such embodiments, for example FIG. 14, effective center of rotation 1901 of pad 1906 is below the surface of the wall being climbed. Such positioning of effective center of gravity 1901 can aid in maintaining a consistent contact pressure and reduce the load on the leading edge of pad 1906. Because the leading edge creeps over new terrain, the leading edge may benefit from reduced loading. Optionally, rolling the leading edge slightly up like a ski tip may be beneficial. Specifically, FIG. 14 shows joint 1900 comprised of first and second semispherical members 1902 and 1903. First and second members 1902 and 1903 are positioned relative to one another such that the inner edge of second member 1903 is slidably engaged with the outer edge of first member 1902. First and second members 1902 and 1903 are preferably made from low friction material. Alternatively, a friction reducing material may be used between first and second members 1902 and 1903 to enhance their movement relative to each other. First member 1902 is preferably securely fasted to pad 1906 by any known fastening means. Further, rod 1905 is used to connect first and second members 1902 and 1903 to arm 1904 (which may be part of an actuator or other device or component of a corner climber according to the invention). Rod 1905 is preferably positioned such that full circular rotation of pad 1906 is permitted. Optionally, rod 1905 may be such that no rotation of pad 1906 is permitted, or such that only partial rotation is allowed. Further, first member 1902 preferably has an opening along its length which is wide enough to have rod 1905 positioned therethrough, but which is also long enough to allow for maximum movement of second member 1903, rod 1905, and arm 1904 relative to first member 1902 and pad 1906. Of course, rod 1905 must be secured to arm 1904 and second member 1903 to provide for such movements. Variations on the spherical configuration are also possible, for example surfaces may be modified so that they are elliptical or otherwise asymmetric for alignment or load distribution purposes. Finally, any of the high friction materials described herein may be used for the surface of pad 1906.

FIG. 15 shows yet another alternate embodiment of a friction pad joint according to the invention. Specifically, shown is a linkage of two members 2001 to pad 2002 through base 2004 like the joint of FIG. 14 which also creates a remote center of rotation. It is preferred that members 2001 are rotatably connected on one end to base 2004 of pad 2002 while rotatably connected on the other end to arm 2003 of a corner climber device. Such rotatable joints can be comprised of pin joints, living hinges, or the like. The typically high normal force allows the use of bearing designs that are unidirectional in nature for most pad retention systems. The momentum produced by misalignment of the line of force resulting from such a design relative to the friction and normal force of pad 2002 using the remote center near or under the wall surface allows pad 2002 to match the surface angle of the wall and also provide a more uniform load distribution on the surface of pad 2002.

Figure 16:
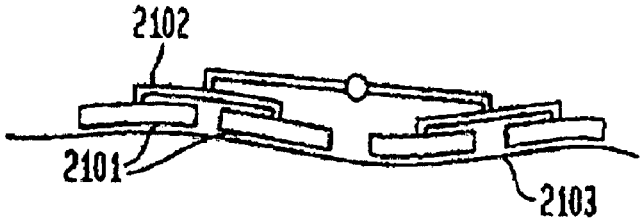
FIG. 16 depicts a top view of a conformal pad linkage for use with the present invention.

Turning next to FIG. 16, for very uneven surfaces 2103, one or a plurality of pads 2101 held on levers 2102 in a manner similar to the way a windshield wiper blade is supported to provide conformal grip capability. One or more flexible pads, similarly held, may be used to provide more accommodation of irregular surfaces 2103 than may be practical with foam backed pads. Even on flat surfaces, the design of FIG. 17 can provide more evenly distributed pad pressure and improved grip performance. However, for most applications, a simple single pad and pivot joint system or ball joint located near the surface of the pad will suffice.

Figure 17:
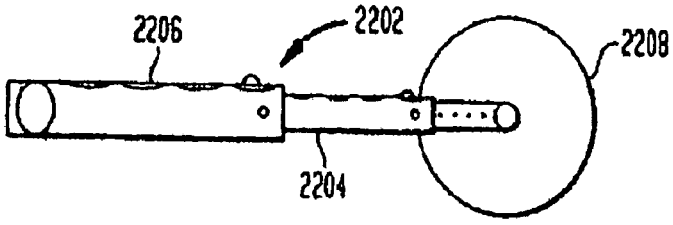
FIG. 17 depicts a telescoping arm of a corner climber in accordance with the present invention.
Figure 18:
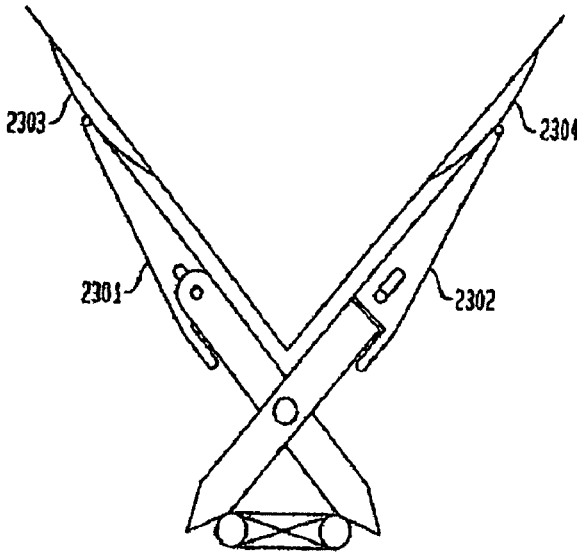
FIG. 18 depicts a top view of flippable arms of a corner climber in accordance with the present invention for use on an outside corner.
Figure 19:
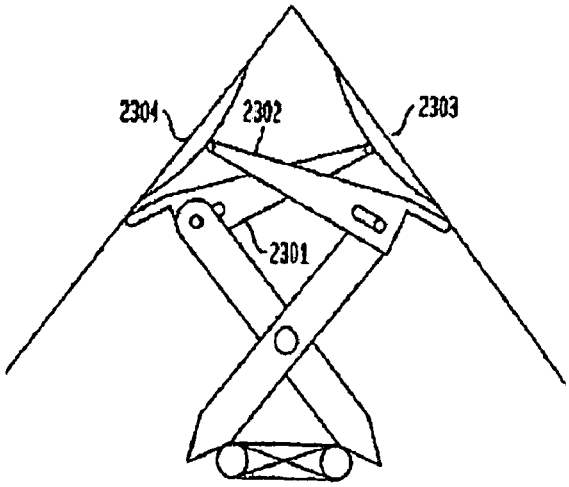
FIG. 19 depicts a top view of flippable arms of a corner climber in accordance with the present invention for use on an inside corner.

To enable use of the above described pads and pad joints in a corner climber according to the invention, they must be attached to an arm or arms, or other means of attachment. For example, a telescoping version of such an arm is shown in FIG. 17. Specifically, shown is telescoping arm 2202 comprising inner and outer tubes 2204 and 2206 slidably engaged to provide an adjustable length which provides a means of changing the location of pad 2208 and accommodating variations in corner geometry, etc. Optionally, the arm may be made automatic, for example, with a screw drive such that it may to screw in or out as required. Preferably, telescoping arm 2202 is connected to pad 2208 using one of the previously described pad joints to allow for maximum rotation of pad 2208. Additionally, non-telescoping arms may be configured with locking joints. For example, FIGS. 18 and 19 depict an embodiment of a corner climber in accordance with the invention that allows arms 2301 and 2302 to be locked in position. Then, arms 2301 and 2302 may be unlocked and repositioned flipped across body to convert from an inside to an outside corner climbing device. Such an embodiment is suitable for anthropomorphic toys, for example. Of course, it is preferred that such arms are connected to friction pads 2303 and 2304 using any of the previously described pad joints. Numerous additional embodiments of arms including arms with locking hinges or detents, arms that can be plugged and unplugged, arms with living hinges and/or compression pads, etc.

Turning next to FIGS. 20A-20B, shown is a preferred embodiment of a human operated outside corner climber in accordance with the invention. This embodiment will serve as an introduction to the method and mechanisms of the many possible outside corner climbers described below in greater detail. As shown, outside corner climber 4200 comprises upper and lower friction pads 4201-4202 and 4209 for gripping the corner surfaces. Preferably, pads 4201-4202 and 4209 comprise any of the high friction material such as Dycem®, Versaflex®, Dynaflex®, Kraton™, Versalloy®, TEEBAUD®, Five-Ten Stealth rubber, etc. Also, the upper clamp assembly comprises clamp arms 4203 and 4204, while lower clamp assembly comprises guide 4214. These are provided with pad joints 4205-4206 (upper) and 4208 (lower) such that pads 4201-4202 and 4209 are positioned for proper gripping on an outside corner, as shown. Further, upper and lower clamp assemblies have pulley assembly 4210-4211 positioned therein such that actuator line 4212 may be run therethrough to control movement of upper and lower clamp arms 4203-4204 and 4214 when force is applied to stirrup 4213. Finally, connecting rod 4207 is provided to attach the upper and lower clamp assemblies together.

Left pad 4201 and right pad 4202 are positioned opposite one another for placement on outside corner surfaces. Pads 4201 and 4202 are mounted on pad clamp arms 4203 and 4204 preferably with joints 4205 and 4206. Clamp arms 4203 and 4204 are mounted on connecting rod member and pivot axle 4207. Optionally, bearings may be used at the ends of pivot axle 4207 depending on the material used for clamp arms 4203 and 4204. The details of the type of bearings used are not critical to an understanding of the operation of the outside corner clamp and would be known to a person of ordinary skill in the art. In this embodiment axial body member 4207 extends downward to guide member 4214 having pads 4209 attached thereto by pad joints 4208. Pads 4209 straddle the outside corner 4208 and grip the wall on each side of the corner. Left arm pulley assembly 4210 and right arm pulley assembly 4211 are mounted on clamp arms 4203 and 4204, respectively. Actuation line 4212 is fed through pulley assemblies 4210 and 4211 and to stirrup 4213. Actuation line 4212 may be fed though guide 4210 and 4211 (although this is not required), and forms a block and tackle arrangement on clamp arms 4210 and 4211 that closes gripper pads 4201 and 4202 against the wall surfaces on either side of the corner upon a downward force applied to the stirrup 4213. Pad joints 4205 and 4206 are preferably ball joint pivots, but other types of joints may be used. FIG. 20B shows a simplified top view of the outside corner climber 4200. In this view, the positions of pad joints 4205 and 4206 are shown more clearly. Specifically, joints 4205 and 4206 allow pads 4201 and 4202, respectively, to conform to the angle of the surface of the wall with little regard for the angle of arms 4203 and 4204 with respect to the walls.

Figure 21:
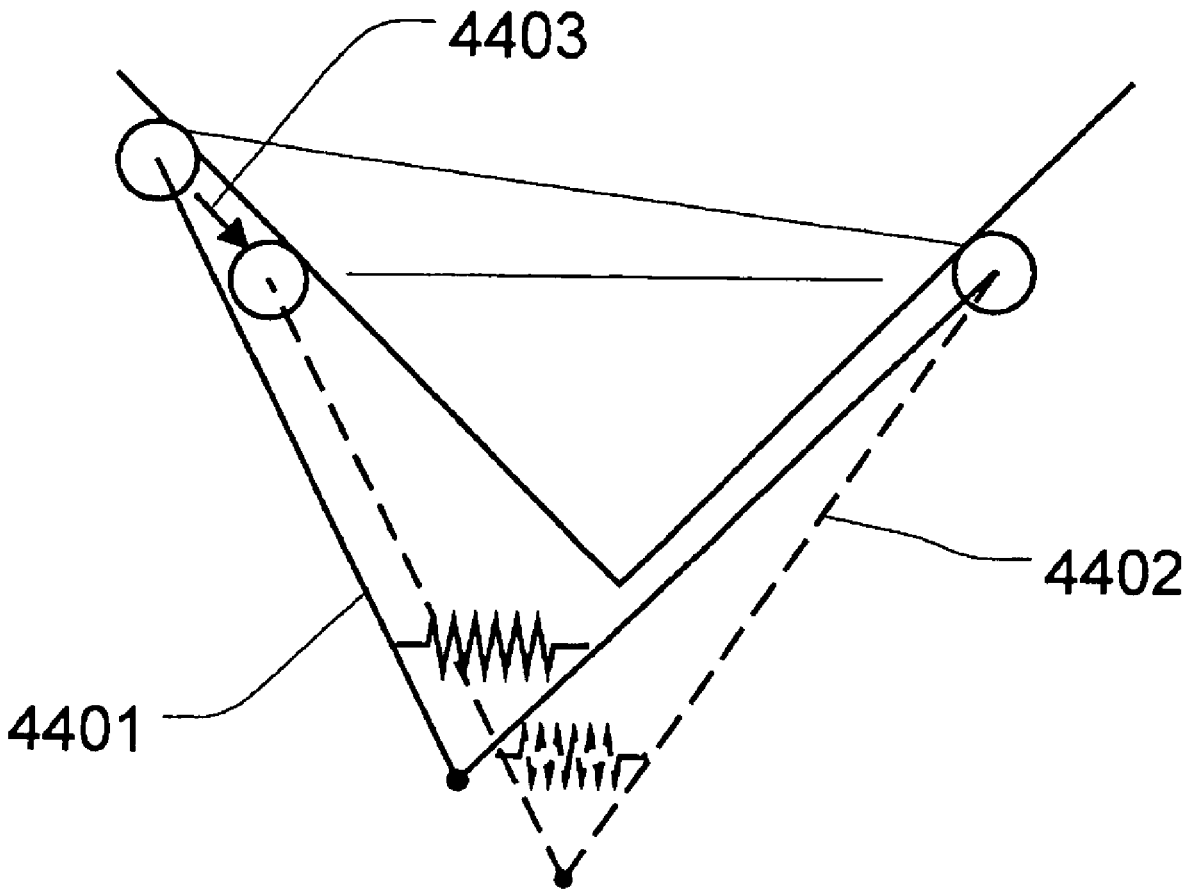
FIG. 21 illustrates the stability of the outside corner climber of FIGS. 20A and 20B.

In operation, outside corner clamp 4200 of FIG. 20A is positioned on an outside corner, as shown. Then, actuation line 4212 is tensioned, generally through application of a downward force on stirrup 4213. Application of tension to actuation line 4212 acts to apply clamp force on both pads 4201 and 4202 through clamp arms 4203 and 4204, respectively. This force, combined with the high friction properties of the surface material on pads 4201 and 4202, allows climber 4200 to hold the outside corner. Similar principles apply to the friction material used on pads 4201 and 4202 as described previously. However, for outside corner climber 4200, creep acting on the two pivoted pads 4201 and 4202 does not produce a self-amplifying instability. In particular, FIG. 21 demonstrates how outside corner climber 4200 is inherently stable in asymmetrical situations on surfaces with similar coefficients of friction. As shown, pad creep (as indicated by arrow 4403) at an initial position 4401 (represented with a solid line) will tend to move towards a more symmetrical position, shown as dashed lines 4402. This happens because when one pad slips, the angle of the force on that pad produces a stronger grip condition thereby reducing the tendency to further slip. Thus, less concern with stability issues related to creep is required for an outside corner condition. If creep does occur, eventually the pads will slide off the edge of the corner, so creep can still limit the duration of the clamp before a re-grip of the corner is required.

In order to climb a corner with an outside corner clamp of this embodiment, at least two clamps are required. A first clamp is placed high on the corner so that the user must raise their foot to place it in the stirrup. Then, the user places their foot in stirrup 4213, which tensions actuation line 4212 so he can stand on stirrup 4213 with his entire weight. The user then places another clamp higher on the same corner, again tensions that stirrup, and stands fully in that stirrup which then releases the first clamp. The user then moves the first clamp higher up the corner and repeats the process. The users maintain their balance by holding on to the clamp foot, clamp arms, or a handle mounted on the device included for this purpose. Of course it is possible with either inside or outside corner climbers to use something other than inserting a foot into a stirrup approach, for example, hands could be used. However, using the legs to climb is disclosed as the preferred method and is used throughout for exemplary purposes because the legs typically have much greater strength and endurance. Hands are then left free for tasks requiring dexterity such as positioning and balance.

Another way to climb using the outside corner clamp could be to place one clamp and climb several stirrup steps placed in that clamp's actuation line, or use a set of stirrups that are attached to the line by ascender devices such as those disclosed in Kammerer, U.S. Pat. No. 4,667,772, which is incorporated herein by reference. Thus, a user can tension the clamp and take several steps up on one clamp before setting another clamp. For instance, it may be possible to climb to the top of the clamp and then stand on it to place the next clamp. Alternatively, the system could be placed between the legs so that he user sits on one of the clamp systems. To do that, some means of maintaining clamp force even when not standing in the stirrup, such as a cleat, would be required.

Figure 22:
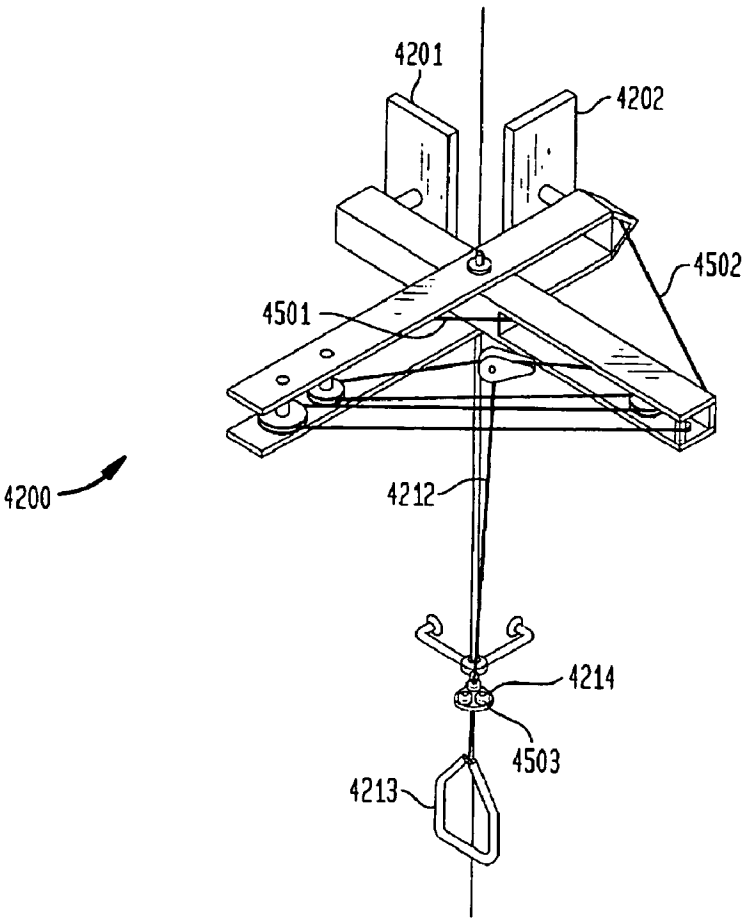
FIG. 22 depicts the outside corner climber of FIG. 20A having enhanced features, including an elastic or spring, a shortening line and a cleat.

Referring next to FIG. 22, shown is outside corner climber 4200 of FIG. 20A with added features, such as an elastic or spring 4501 that brings clamp 4200 to a suitable neutral position, and/or allows clamp 4200 to hold itself without the use of stirrup 4213, are useful. An elastic or line 4502 may also be used to assist with opening pads 4201 and 4202. In addition, cleat 4503, in this case mounted to guide assembly 4214, would allow the user to lock in actuation line 4212 tension. If substantial creep occurs, then the pad force is reduced if there is not some means of maintaining actuation line 4212 tension (i.e., taking up the slack) while it is held by cleat 4503. One means of achieving a preloaded system that accommodates creep is to use spring arms to store energy in the clamping system (not shown). Then, if pads 4201 and/or 4202 creep, the clamp force is maintained at a relatively high value by the tension of the springs.

Figure 23:
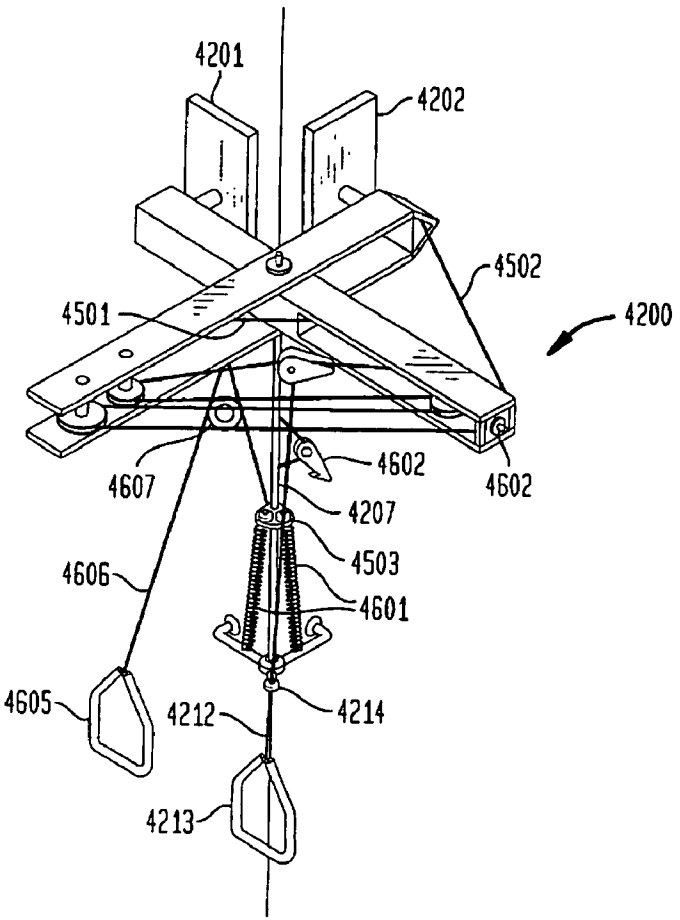
FIG. 23 depicts the outside corner clamp of FIG. 22 with a spring loaded cleat.

An alternative embodiment to the spring arms may be used and is shown in FIG. 23. That is, adding cleat spring(s) 4601 and cleat latch 4602 provides an arrangement that can be used to preload cleat 4503 on actuation line 4212 to provide a steady force even when pads 4201 and 4202 creep. As shown, cleat 4503 is mounted on the axial body member 4207. Cleat 4503 is pulled up to latch 4602 using cleat spring loading stirrup 4605, loading actuation line 4606, and cleat-spring preloading pulley assembly 4607. Once cleat 4503 is pulled up to and secured by latch 4602. Then when actuation line 4212 is placed in cleat 4503 and the latch 4602 is released, spring(s) 4601 acting on cleat 4503 maintain tension in actuation line 4212 even when pad creep cases clamp 4200. Thus, using the spring-loaded cleat as shown in FIG. 23, the grip of clamp 4200 can be held even without weight on actuation stirrup 4213. This will allow added flexibility in moving around since full weight can be applied to other clamps without fully releasing clamps that are well set.

Figure 24:
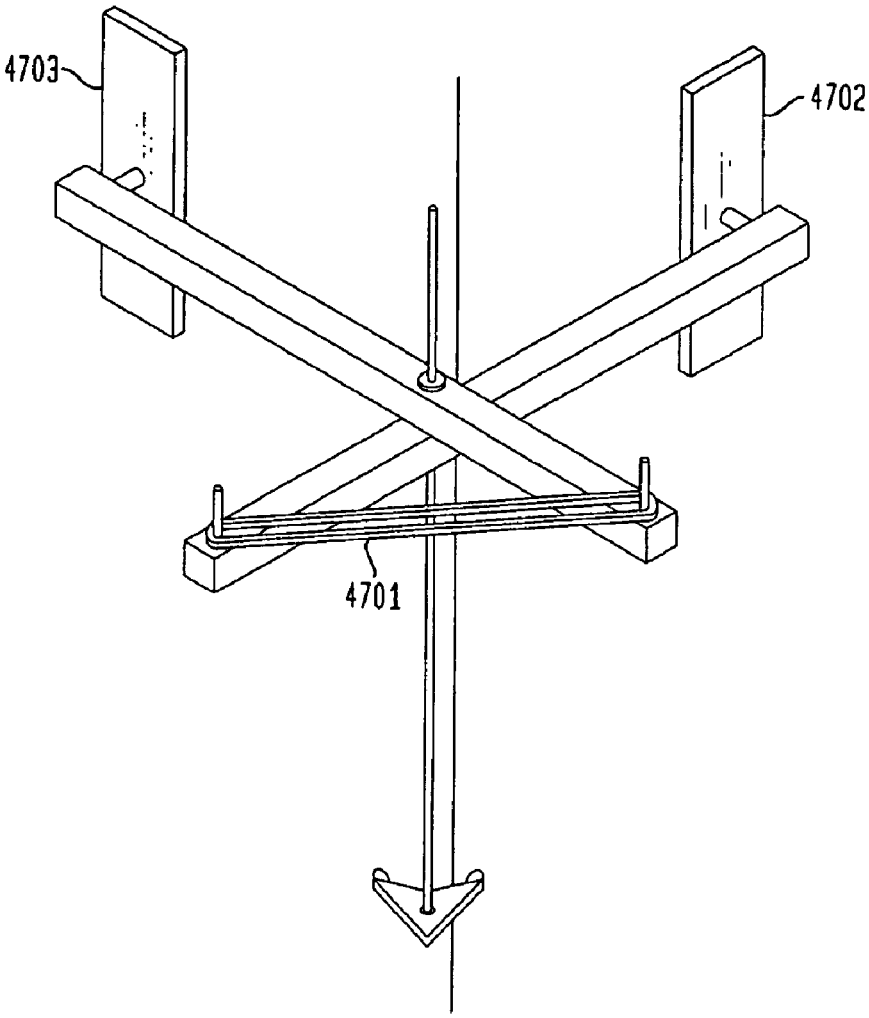
FIG. 24 depicts the outside corner climber of FIG. 22 with elastic (or spring-loaded) clamps.

Alternately, a portion of actuation line 4212 from outside corner clamp 4200 of FIG. 20A may be replaced by an elastic band or a tension spring to accommodate creep as depicted in FIG. 24. Any tension generating member may be used in place of the elastic to generate a clamp force in this manner. For example, the clamp actuation system can be replaced by high tension elastic 4701 shown in FIG. 24. Elastic 4701 may be preloaded so that adequate clamp force is applied to pads 4702 and 4703 over a wide range of motion.

Figure 25:
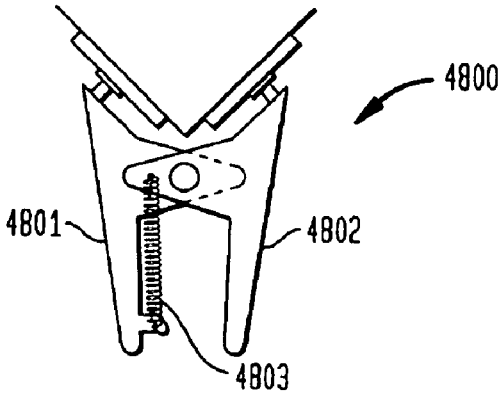
FIG. 25 depicts a top view of the outside corner climber of FIG. 22 with cloths-pin clamp configuration.

Yet another alternative embodiment of an outside corner climber is shown in FIG. 25. Specifically, FIG. 25 illustrates a top view of outside corner clamp 4800 having a clothespin clamp configuration. Such a design allows for convenient manual operation simply by squeezing handles 4801 and 4802 in a manner-similar to a cloths-pin to release clamp 4800. As shown, tension spring 4803 is used to maintain a clamp force unless handles 4801 and 4802 are squeezed together. Additional springs may be used and can be placed on both sides of clamp 4800. The specific geometry of the spring mounting points is chosen to provide a relatively constant clamp force. For this configuration, a pulley system can replace spring 4803 to provide a system similar to that of FIG. 20A. The pulleys may be arranged to provide the ungripping force while the spring provides the gripping force. Alternatives such as use of a compression spring placed between the handles may also be used.

The corner climbers described herein can be utilized for many tasks in many ways. If a task is to place and/or hold a payload at a given location, then it is not necessary that the climber take the payload as it climbs. Instead, the climber can leave the payload behind while it climbs, and then hoist it up after it reaches a target position. In this manner, the climber can be smaller, lighter, and/or faster. Once the robot is in position, then it can use all available grip power (or glue itself in place) to hold while the payload lifts itself up (by a wince in the payload for example), or is raised. Note that many of the climber embodiments release and move grips to climb, so when there is no need to climb, substantially more grips can be engaged. The payload may include the batteries for example. In that case, wires or other power transmission means allows substantial sized batteries to be used to climb because the battery weight can be left behind during the climb. It is also possible that the payload could be lifted and secured and the battery left behind, and/or that the robot can climb or jump back down once the payload is secured in place. Thus, the robot could be reused. There are many ways to implement and utilize a climbing system according to the invention, especially since the basic gripping and holding action requires little power.

Much of the discussion to this point has been described in terms of adhesion to one or more surfaces and/or friction based on contact of two grippers. It is noted here that the invention also applies to multiple surfaces and grippers. The use of paired grippers made description simpler and is often the simplest embodiment, but the three/four point grip described for anthropomorphic climbers or any other grip arrangement is part of the present invention. Multiple grips on multiple surfaces, on the wall/wall/ceiling surfaces for a three surface example, are also feasible.

Many of the embodiments described herein utilize springs as energy storage systems and cams as force amplifiers. There are many alternatives for these actuators. Springs may be based on solid or gas springs. Gas generators or charges such as bullet shells can be used for power. TiNiAl alloy or a similar a shape memory alloy can be used in combination with a temperature changing system to provide an actuator. Plastic shape memory alloys and artificial muscles are currently under development and promise additional and possibly lower cost actuators. A spring clamp with actuator retraction system is suited for the shape memory alloy or artificial muscle actuator. Batteries are currently one of the more convenient electric power storage/source options. Fuel cells are becoming more practical as a power source and may be used. Nuclear powered generators of heat and/or electricity could be used in some applications. Engines of various types can be used and photocells could be used to provide a power source.

Any number of linkages such as those used for Vice Grips™, locking pliers, force multiplying pliers, pruning shears, hedge trimmers, and the like can be used to amplify (or de-amplify if desired) actuator force for the clamping system. Pneumatics and hydraulics may also be utilized. Pulleys and purchase arrangements are also convenient for achieving force amplification in some applications.

Most of the concepts of any of the embodiments presented can be applied to any other embodiment in whole or in part. Designs can be coupled to each other to create snake-like trains of systems/couplings with controllable joints allow transitions from one type of corner to one at another angle and/or of another type. There is no limitation on how large or small the invention can be. Very small versions might be made light enough to climb flat walls without corners since some materials are able to stick to a surface if the force pulling away is small. The possibility of climbing free of the corner is also enabled by suction cups or application of adhesives, or if you can climb faster than it slips, then a slipping traction may be adequate. Adhesive technologies such as Post it Notes™ type adhesives with and/or without backing would allow grippers to hold on flat surfaces.

While the present invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

What is claimed is:

1. A corner climber comprising:

a first member comprising a first cavity extending along a longitudinal length of said first member;

a second member interconnected with said first member such that said first member cooperates with said second member to provide a first clamping force;

a connecting rod for coupling said first member to said second member along a common pivot axis, said common pivot axis being orthogonal to said first and said second members;

a control device for activating said first member and said second member to provide said first clamping force;

a first friction pad coupled to said first member, wherein said first friction pad engages a first surface such that said first friction pad is substantially flush with said first surface; and a second friction pad coupled to said second member, wherein said second friction pad engages a second surface such that said second friction pad is substantially flush with said second surface; and a cleat spring coupled to a cleat latch for maintaining said first clamping force when said control device is not activated;

wherein said first and said second surfaces are at an angle at least about 270 degrees with respect to each other;

wherein said first and said second friction pads comprises a high friction material having a coefficient of friction equal or greater than one; and wherein said first clamping force and said high friction material causes said first friction pad and said second friction pad to securely engage said first and said second surfaces.

2. An apparatus according to claim 1, wherein at least one of said friction pads comprises at least one layer.

3. An apparatus according to claim 2, wherein said layer is removable.

4. An apparatus according to claim 1, wherein at least one of said friction pads comprises at least one selected from a group consisting a flat surface, a concave surface, and a convex surface.

5. An apparatus according to claim 1, wherein at least one of said friction pads comprises a material selected from a group consisting of polyester composite PVC compound, a thermoplastic elastomer, rubber and cyanoacrilate.

6. An apparatus according to claim 1, wherein said control device comprises at least one pulley system, said pulley system comprising: at least one roller; and at least one cable cooperating with said at least one roller, said cable attached to at least one of said members; wherein tension applied to said cable is transferred to said members to provide said first clamping force.

7. An apparatus according to claim 1, wherein said apparatus further comprises a means for repositioning said members upon release of said first clamping force such that said members move relative to said first and said second surfaces.

8. An apparatus according to claim 7, wherein said means for repositioning stores potential energy upon application of gravity to said apparatus, wherein the release of said potential energy causes said moving of said members.

9. An apparatus according to claim 7, wherein said means for repositioning comprises a swinging weight.

10. An apparatus according to claim 1, wherein said first and said second surfaces form an outside corner.

* * * * *